US006148620A

United States Patent [19]

Kumagai et al.

[11] Patent Number: 6,148,620

[45] Date of Patent: Nov. 21, 2000

[54] ICE MAKING DEVICE AND METHOD OF CONTROLLING THE SAME

[75] Inventors: Hideo Kumagai; Kazunori Nishikawa, both of Nagano, Japan

[73] Assignee: Kabushiki Kaisha Sankyo Seiki Seisakusho, Nagano, Japan

[21] Appl. No.: 09/282,467

[22] Filed: Mar. 31, 1999

[30] Foreign Application Priority Data

May 15, 1998 [JP] Japan ..... 10-152017

[51] Int. Cl.[7] ..... F25C 5/06

[52] U.S. Cl. ..... 62/72; 62/135; 62/353

[58] Field of Search ..... 62/72, 135, 353

[56] References Cited

U.S. PATENT DOCUMENTS

| | | | |
|---|---|---|---|
| 4,402,194 | 9/1983 | Kuwako et al. | 62/353 |
| 4,424,683 | 1/1984 | Manson | 62/135 |
| 5,400,605 | 3/1995 | Jeong | 62/353 |
| 5,642,628 | 7/1997 | Whipple, III et al. | 62/186 |
| 5,675,975 | 10/1997 | Lee | 62/353 |
| 5,836,168 | 11/1998 | Lee | 62/353 |
| 5,881,563 | 3/1999 | Lee et al. | 62/353 |
| 5,993,117 | 11/1999 | Lancaster et al. | 406/3 |

FOREIGN PATENT DOCUMENTS

| | | | |
|---|---|---|---|
| 9-264646 | 10/1997 | Japan | F25C 1/10 |

*Primary Examiner*—William E. Tapolcai

*Attorney, Agent, or Firm*—Sughrue, Mion, Zinn, Macpeak & Seas, PLLC

[57] ABSTRACT

An automatic ice making machine 1 includes an ice tray 2 for making ice cubes, ice separating means 5 for separating ice cubes from the ice tray 2 by turning the ice tray 2, and an ice storage container for storing separated ice cubes. A stepping motor 13 is used for a drive source for the driver unit 5. The automatic ice making machine further includes detecting means for detecting a predetermined position of the ice tray 2; and control means for controlling a drive of the stepping motor 13. When the ice tray 2 is returned to the water supply position, the control means determines a predetermined position of the ice tray 2 by use of a signal from the detecting means, and determines other positions of the ice tray 2 by the utilization of the number of steps of the motor counted from the predetermined position. When the ice tray 2 is returned to the water supply position, the control means turns the ice tray 2 beyond the ice making position and the water supply position in the opposite direction to the ice separation position, and then turns the ice tray 2 toward the ice separation position and returns the ice tray 2 to the water supply position. Therefore, the amount of water to the ice tray 2 is increased.

12 Claims, 27 Drawing Sheets

(CONT.)

(FIG.16 CONTINUED)
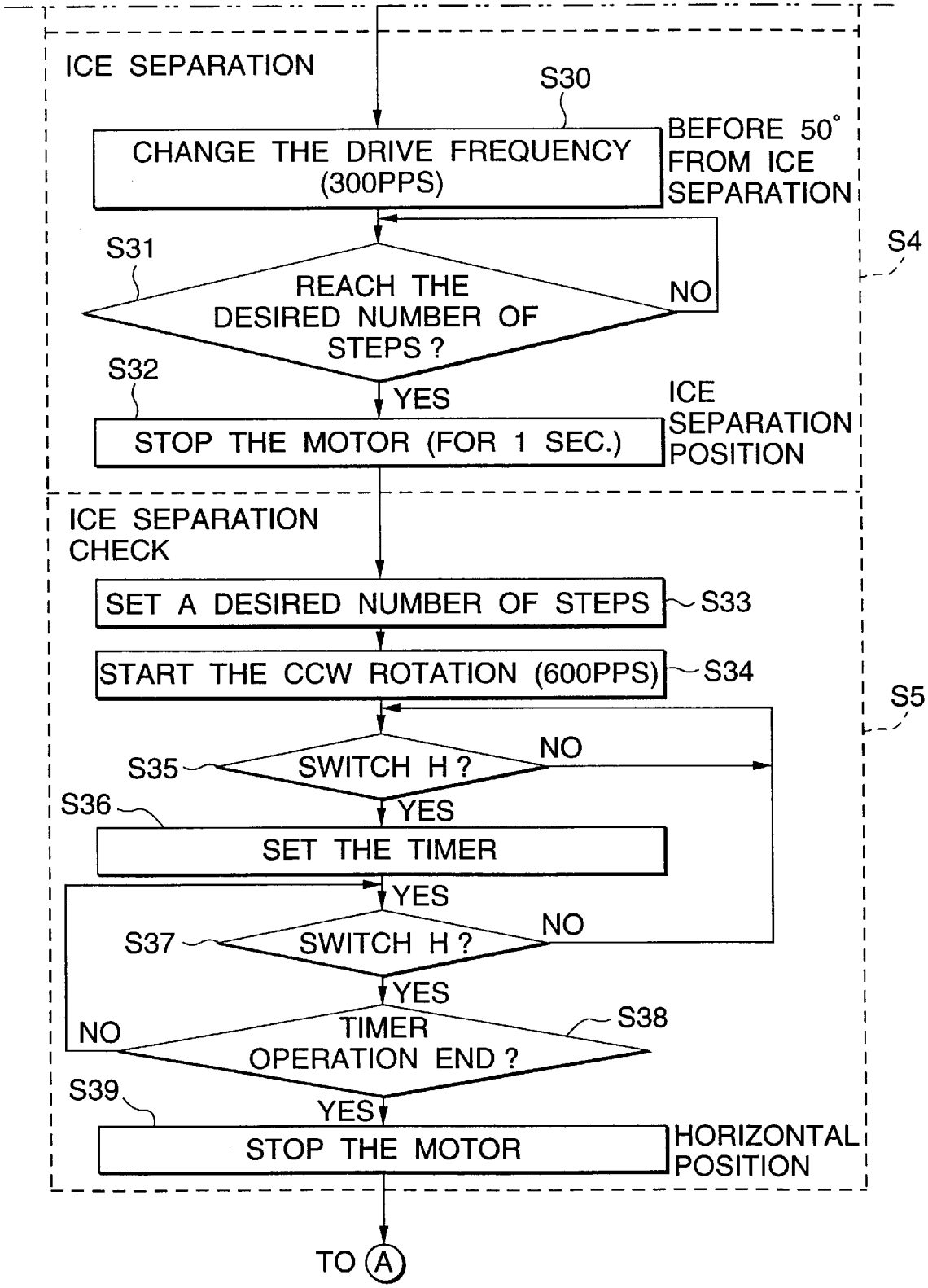

(FIG.17 CONTINUED)
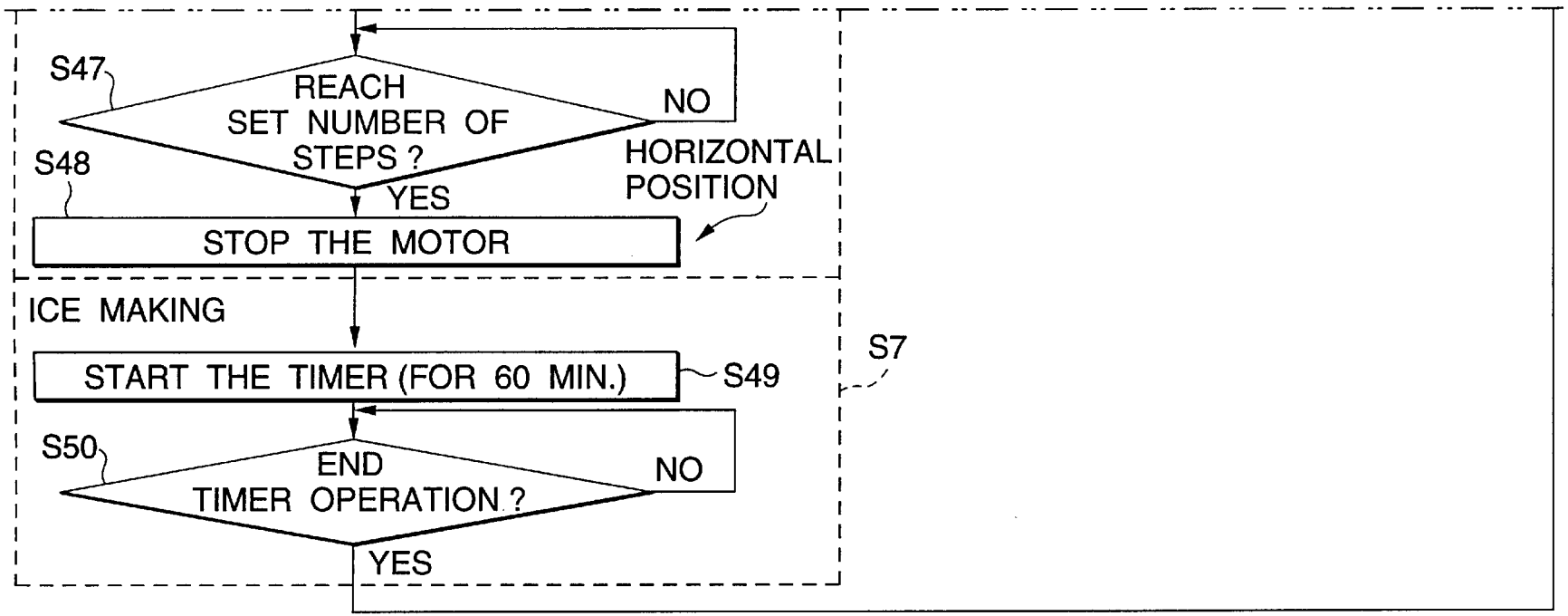

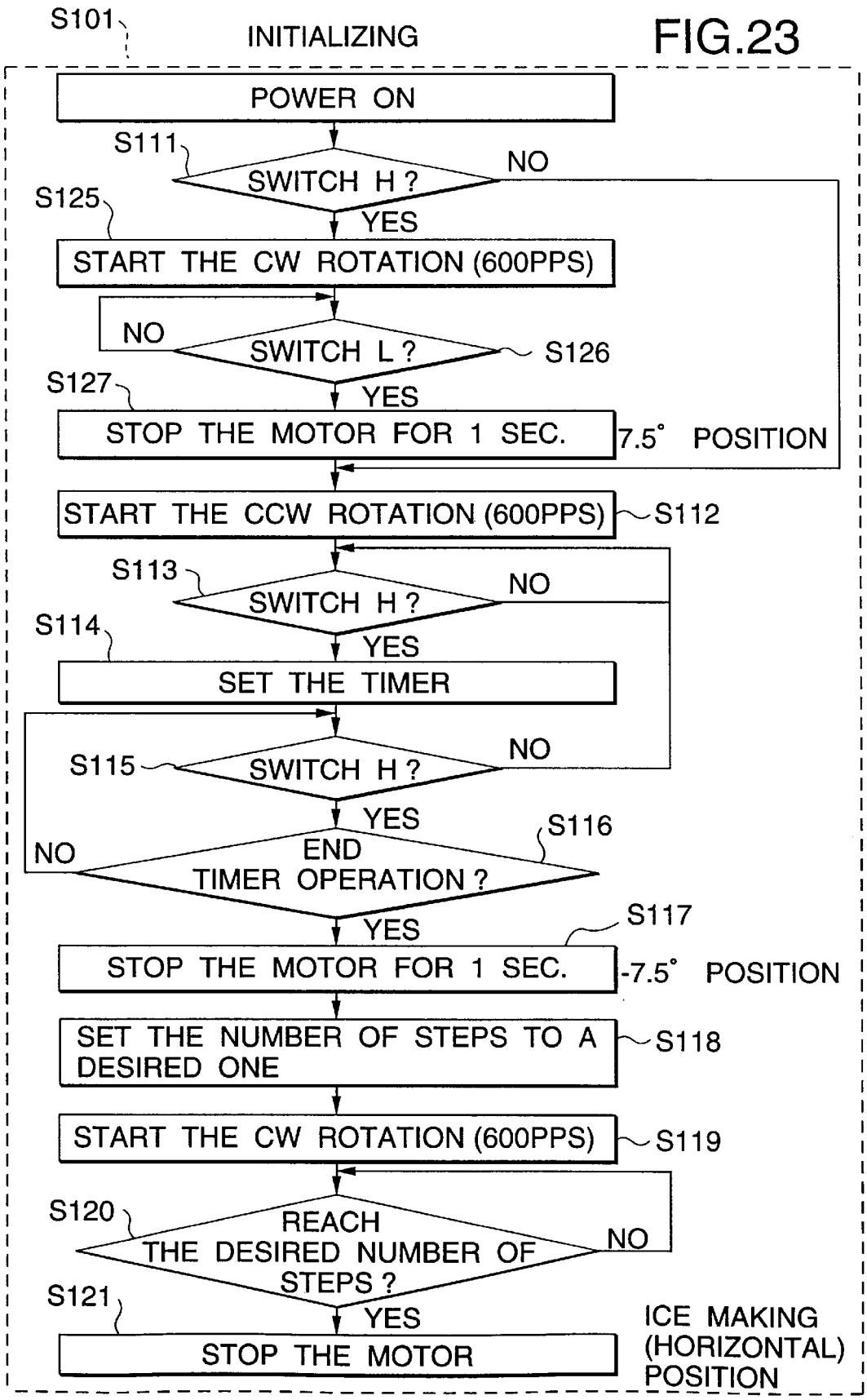
S101
INITIALIZING
FIG.23
POWER ON
S111
SWITCH H ?
NO
YES
S125
START THE CW ROTATION (600PPS)
NO
SWITCH L ?
S126
S127
YES
STOP THE MOTOR FOR 1 SEC.
7.5° POSITION
START THE CCW ROTATION (600PPS)
S112
S113
SWITCH H ?
NO
S114
YES
SET THE TIMER
S115
SWITCH H ?
NO
YES
S116
NO
END
TIMER OPERATION ?
YES
S117
STOP THE MOTOR FOR 1 SEC.
-7.5° POSITION
SET THE NUMBER OF STEPS TO A DESIRED ONE
S118
START THE CW ROTATION (600PPS)
S119
S120
REACH
THE DESIRED NUMBER OF STEPS ?
NO
S121
YES
STOP THE MOTOR
ICE MAKING (HORIZONTAL) POSITION

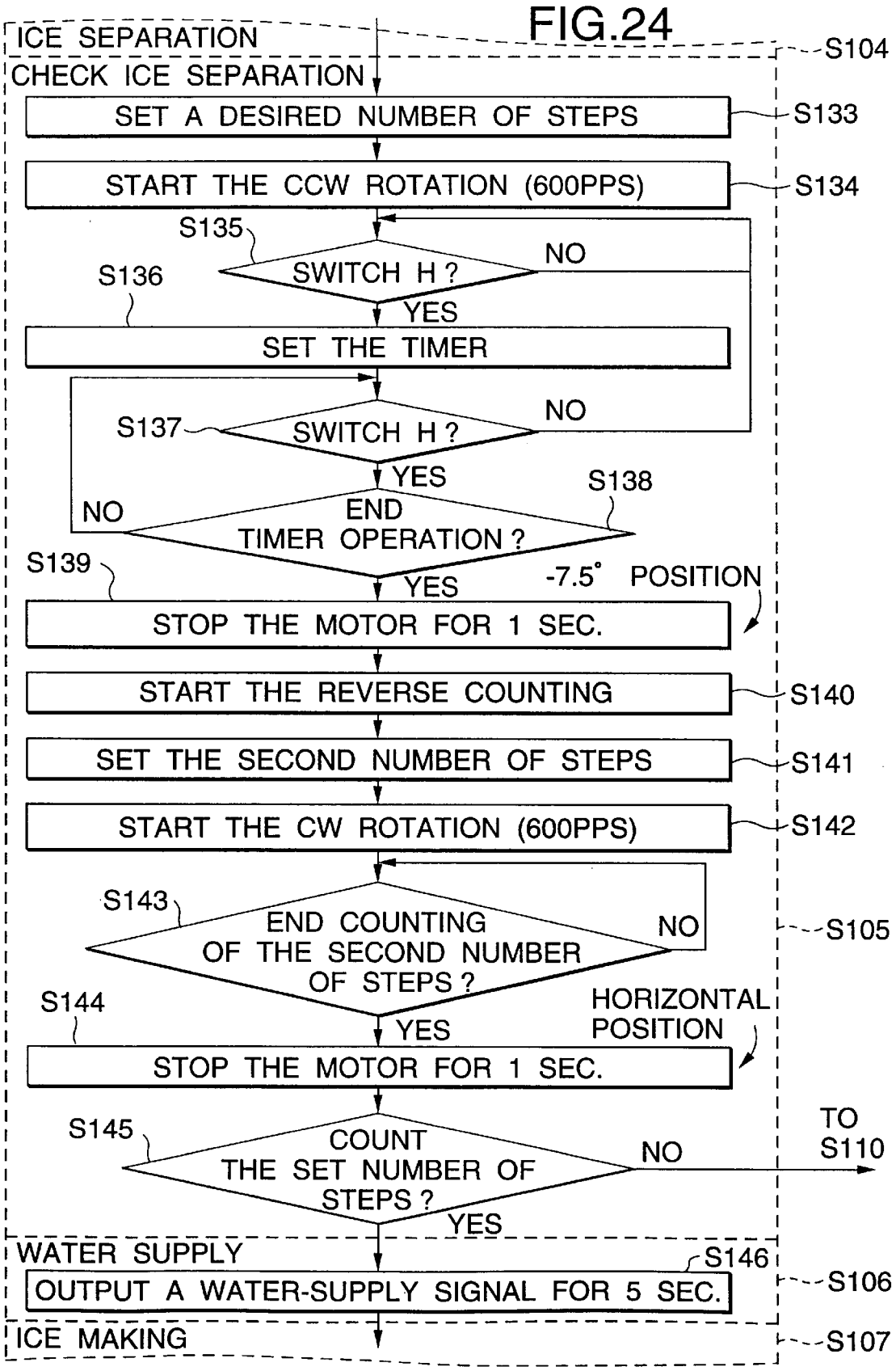
FIG.24
ICE SEPARATION
S104
CHECK ICE SEPARATION
SET A DESIRED NUMBER OF STEPS
S133
START THE CCW ROTATION (600PPS)
S134
S135
SWITCH H ?
NO
YES
S136
SET THE TIMER
S137
SWITCH H ?
NO
YES
S138
NO
END TIMER OPERATION ?
S139
YES
-7.5° POSITION
STOP THE MOTOR FOR 1 SEC.
START THE REVERSE COUNTING
S140
SET THE SECOND NUMBER OF STEPS
S141
START THE CW ROTATION (600PPS)
S142
S143
END COUNTING OF THE SECOND NUMBER OF STEPS ?
NO
S105
S144
YES
HORIZONTAL POSITION
STOP THE MOTOR FOR 1 SEC.
S145
COUNT THE SET NUMBER OF STEPS ?
NO
TO S110
YES
WATER SUPPLY
S146
OUTPUT A WATER-SUPPLY SIGNAL FOR 5 SEC.
S106
ICE MAKING
S107

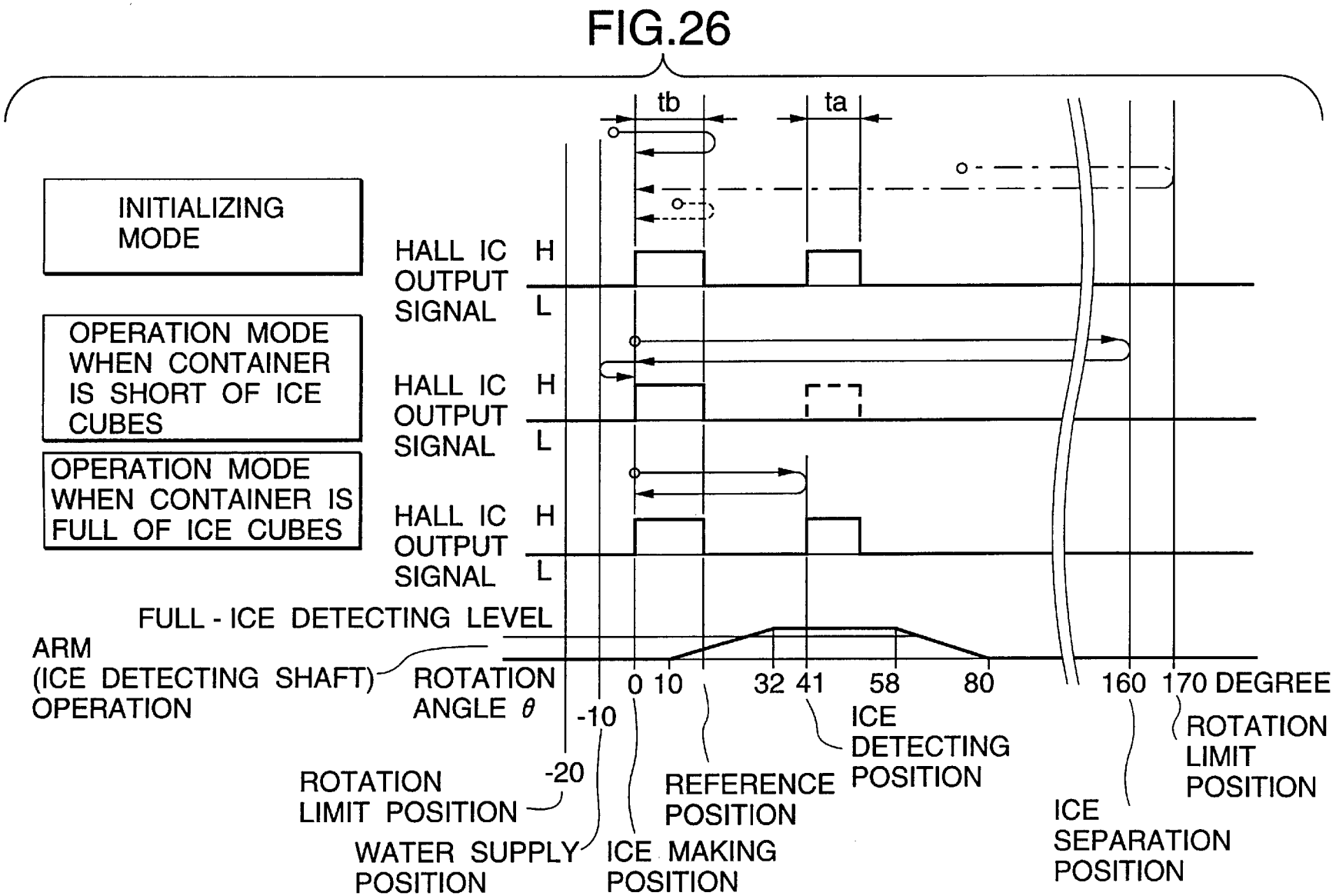
FIG.26
INITIALIZING MODE
OPERATION MODE WHEN CONTAINER IS SHORT OF ICE CUBES
OPERATION MODE WHEN CONTAINER IS FULL OF ICE CUBES
HALL IC OUTPUT SIGNAL
H
L
ta
tb
ARM (ICE DETECTING SHAFT) OPERATION
FULL - ICE DETECTING LEVEL
ROTATION ANGLE θ
-20
-10
0
10
32
41
58
80
160
170 DEGREE
ROTATION LIMIT POSITION
ICE SEPARATION POSITION
ICE DETECTING POSITION
REFERENCE POSITION
ICE MAKING POSITION
WATER SUPPLY POSITION
ROTATION LIMIT POSITION

ICE MAKING DEVICE AND METHOD OF CONTROLLING THE SAME

BACKGROUND OF INVENTION

1. Field of the Invention

The present invention relates to an ice making device, installed in a refrigerator, for supplying ice cubes made to a ice storage container when the ice cubes are insufficient in the container, and a method of controlling an ice making device thus functions.

2. Related Art

Recently, a home-use refrigerator with an automatic ice making device has been sold in market. A drive device is used for driving the automatic ice making device of the refrigerator. One of the known drive devices is disclosed in JP-A-9-264646. In this device, an ice detecting arm for detecting an amount of ice cubes in the ice storage container is operated by an AC motor or a DC motor. In most cases, the ice detecting arm is driven by use of a cam face of a cam gear as described in the publication stated above.

The cam gear has at least three positions; an ice making position where the ice detecting arm is put in a stand-by place, an ice detecting position for detecting as to if the ice storage container is full of ice cubes, and an ice separation position for separating ice cubes from the ice tray in co-action with a twist of the tray, and put them into the ice storage container.

When the cam gear is rotated, the ice detecting arm is vertically moved to detect an amount of ice cubes in the container. Through the detecting operation, to check the current position of the ice detecting arm, three signals are respectively generated at the ice making position, the full-ice position and the ice separation position. The motor for driving the ice detecting arm is controlled in on/off and its rotation direction in accordance with those signals. A Hall IC device or a switch device is used for generating those signals.

The conventional ice making device is designed such that the angular control of the ice tray is impossible by use of only the DC motor. For this reason, one Hall IC device as an origin sensor is used commonly for sensing the ice separation position, the ice making position and the ice detecting position. Where the water supply position is different from the ice making position, it is very difficult to control the ice making device because of the use of one sensor. For example, where the water supply position is located at a position slightly shifted to a region not including the ice separation position, the single sensor must take a role of a water supply position sensor, in addition to the sensors for the origin, ice separation position, ice making position, and ice detecting position. The control for searching for an origin point in an initial stage after the power-on of the device is difficult.

When the origin searching is performed, if the ice tray reaches the water supply position, water is automatically supplied to the ice tray since the mechanism is so constructed. Therefore, it is necessary to design the ice making device so that the ice tray is not moved to the water supply position in the initial stage. When one sensor having a multiple of functions is used, such a design is very difficult.

In a conventional method of controlling the ice making device, the tray is thrust upon a mechanical locking position located in a region including the ice making position, in the initializing mode of the ice making device. With this, if the ice tray is turned (reversely) beyond the ice making position, and the water supplying operation is performed, the water is supplied to the ice tray and is mechanically locked even in the initializing mode. This should be avoided. In the conventional control method where the ice tray is slightly turned beyond the ice making position in the reverse direction and mechanically locked, the water supplying operation, which should be avoided in the initializing mode, is automatically performed in this mode.

A method of controlling an ice making device is disclosed in JP-A-9-26464. In this method, the tray is always mechanically locked in the initializing mode. Therefore, every time the device is initialized, the cam gear hits a protrusion of the case to generate vibration and impact sound. Those sounds a little jar so that user's nerves negligible in daytime, but these are noisy in the quiet place at night. The user may mistake the refrigerator as the defective one. This will reduce the product quality of the refrigerator.

SUMMARY OF INVENTION

Accordingly, an object of the present invention is to provide an ice making device which can prevent an ice tray from being inversely turned beyond an ice making position, eliminate vibration and impact sounds.

Another object of the invention is to provide a method of controlling the ice making device.

Still another object of the invention is to provide a method of controlling an ice making device, which when a water supply position is absent in a region to which the tray is reversely turned, vibration sound and impact sound are not generated, and a sufficient amount of water is supplied to the ice tray.

In an ice making device constructed according to the present invention, only a predetermined position is detected by detecting means, and the positioning of other positions may be controlled by use of the number of steps of a stepping motor. Therefore, in an initializing mode, the ice tray may reversely be turned beyond an ice making position. Further, in this mode, no mechanical locking phenomenon occurs, and vibration sound and impact sound are not generated.

In a method for controlling the ice making device, a reference position of the ice tray is detected by detecting means, and a turn of the ice tray from it to another position is measured in terms of the number of steps of the stepping motor. Therefore, the ice tray may be driven in various manners, and no mechanical locking phenomenon occurs in the initializing mode.

BRIEF DESCRIPTION OF DRAWINGS

FIG. 23 is a flow chart showing an initializing program executed by the controller in the FIG. 20 ice making machine;

FIG. 24 is a flow chart showing the details of an ice making step and a water supply step in the FIG. 20 ice making machine;

FIG. 26 is a chart showing an operation of another automatic ice making machine constructed according to a second embodiment of the present invention.

DETAILED DESCRIPTION OF PREFERRED EMBODIMENTS

The preferred embodiments of the present invention will be described with reference to the accompanying drawings. An ice making device and method of controlling the ice making device, which are constructed according to a first aspect of the present invention, will first be described with reference to FIGS. 1 though 20.

Figure 1:
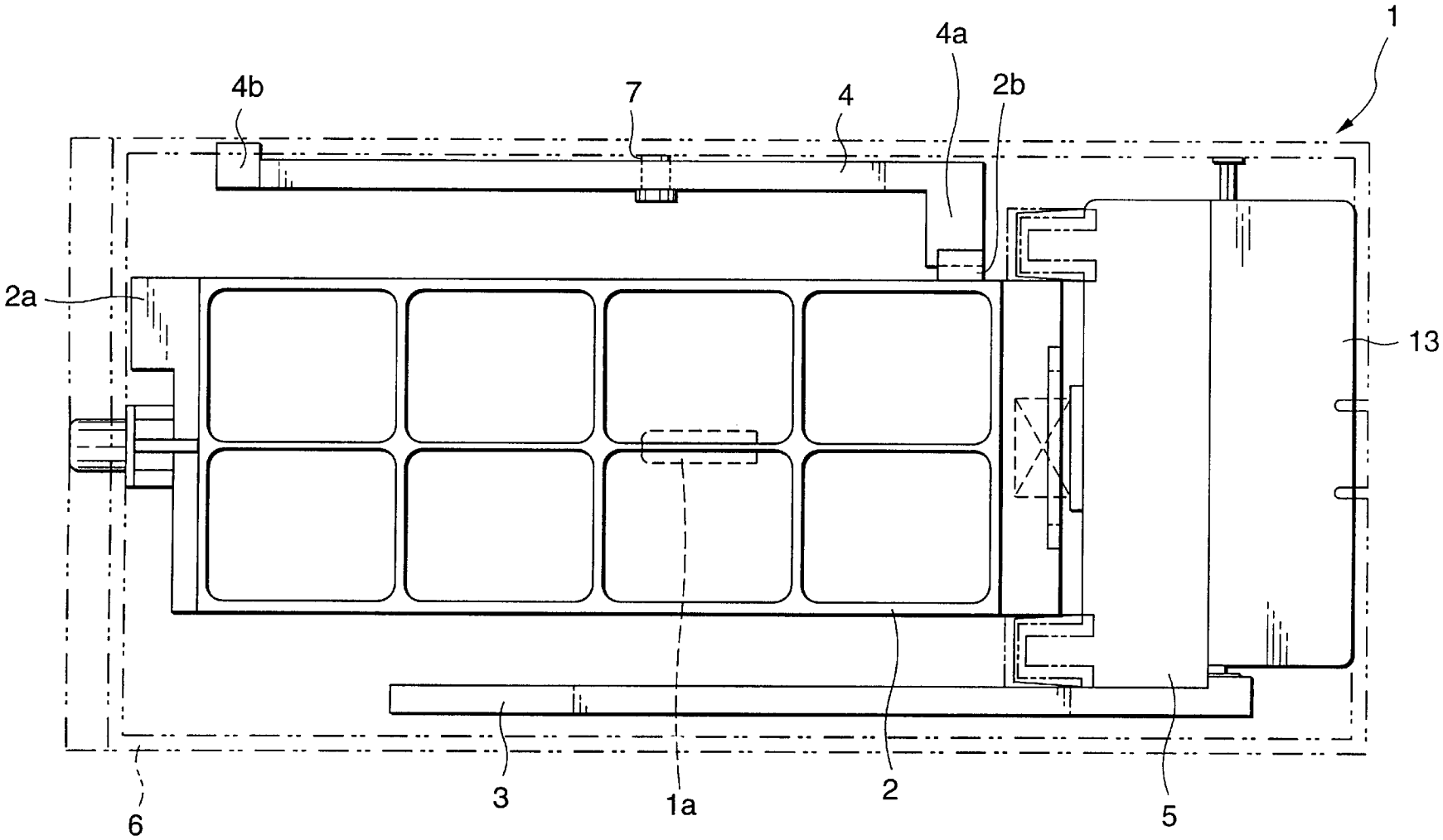
FIG. 1 is a plan view showing a major portion of an ice making device which is a first embodiment of the present invention.
Figure 2:
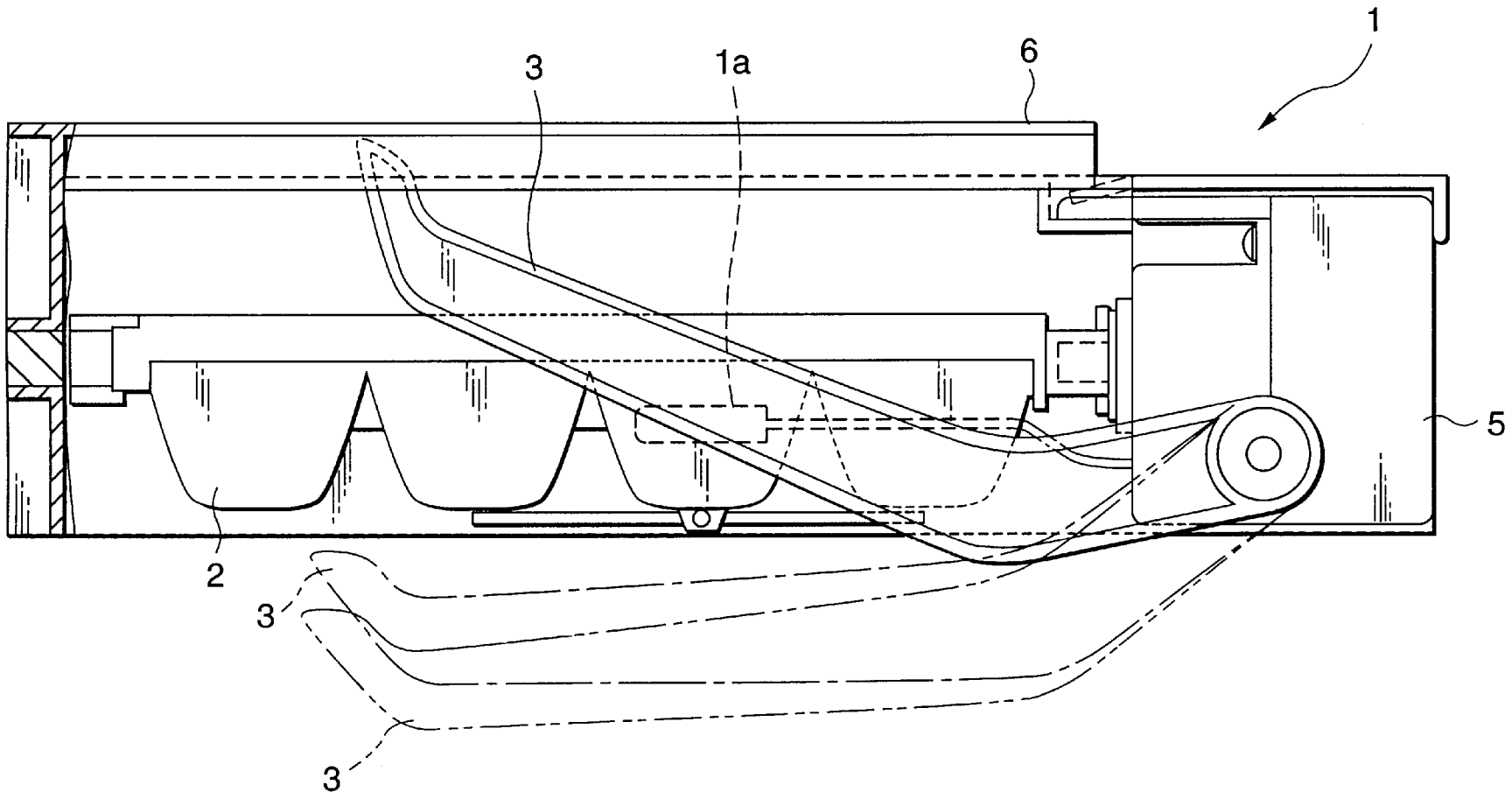
FIG. 2 is a side view showing the automatic ice making machine of FIG. 1.
Figure 3:
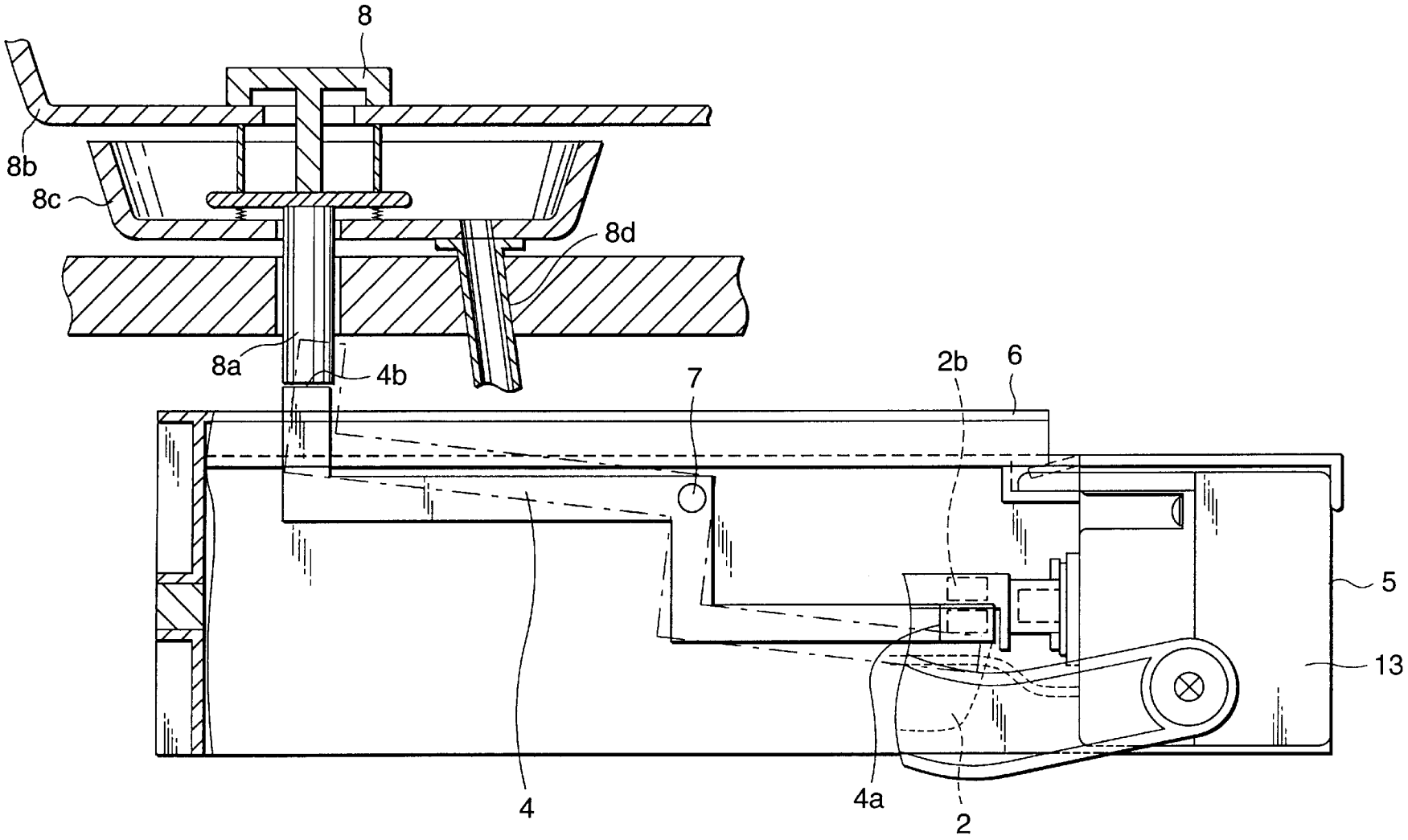
FIG. 3 is a side view showing the FIG. 2 ice making device from which an ice tray is removed and to which a water reservoir tank and others are added.

FIGS. 1 through 3 show the ice making device constructed according to the first aspect of the present invention. In the embodiment, the ice making device takes the form of an automatic ice making machine 1 for making ice cubes and separating the same. The automatic ice making machine 1 is located within a freezer of a home-use refrigerator, and is operated by a driving method which will be described later.

The automatic ice making machine 1 is composed of an ice tray 2, an ice detecting arm 3, a swing member 4, and a driver unit 5 serving as the ice separating means. The ice tray 2 is disposed above an ice storage container (not shown). The ice detecting arm 3 forms ice detecting means which is vertically movable to detect an amount of ice cubes within the ice storage container. The swing member 4 forms liquid-supply operating means for supplying liquid, e.g., water, to the ice tray 2. The driver unit 5 forms ice separation means for driving the ice tray 2, the ice detecting arm 3 and the swing member 4 in an interlocking manner. A thermistor 1*a* for detecting temperature of the ice tray 2 is located under the ice tray 2. In the embodiment, the liquid is drinking water (tap water), ordinarily used in home. The driver unit 5 lowers the tip of the ice detecting arm 3 into the ice storage container, and a distance of the lowering of the arm is used for detecting as to whether or not ice cubes or cubes are present in the ice storage container. When an insufficient amount of ice cubes is contained in the ice storage container, the driver unit 5 reverses the ice tray 2 (up side down position) and causes the ice tray 2 to discharge ice cubes into the ice storage container (at an ice separation position) will be referred to as an ice separation position). Specifically, when the ice tray 2 is reversed, a protruded portion 2*a* of a second end of the tray is brought into contact with a contact piece (not shown) formed on a machine frame 6 of the automatic ice making machine 1, and the ice tray 2 is twisted. Then, ice cubes are squeezed out of the pockets of the tray by the utilization of its twist, and drop into the ice storage container. Thereafter, the driver unit 5 returns the ice tray 2 to its original position, i.e., the ice making position.

In an ordinary automatic ice making machine, water is supplied to the ice tray 2 at this ice making position. In the automatic ice making machine 1 under discussion, the ice tray 2 is rotated slightly (e.g., 10 to 20°) beyond the ice making position. As the result of the reverse turn of the ice tray, an engaging portion 2*b* of the ice tray 2 engages a first end 4*a* of the swing member 4, and the swing member 4 is turned about a shaft portion 7 as a fulcrum provided on the machine frame 6. With the turn of the ice tray, a second end 4*b* of the swing member 4 opens the valve 8 to allow water to be supplied to the ice tray 2. It is noted that the engaging portion 2*b* of the ice tray is located in the vicinity of the driver unit 5. Because of this, a drive force is easily transmitted from an output shaft 25 of the driver unit 5 (to be described in detail).

As shown in FIG. 3, when the first end 4*a* of the swing member 4 is pressed downward, the second end 4*b* thereof moves upward. This lifting second end 4*b* is located farther from the driver unit 5. The second end 4*b* of the swing member 4 comes in contact with an operation bar 8*a* to push the valve 8 upward with the aid of the operation bar 8*a*. When the operation bar 8*a* lifts, water flows into a water receiving case 8*c* within a water reservoir tank 8*b*, and water is supplied to the ice tray 2 through a water-supply pipe 8*d*.

Figure 4:
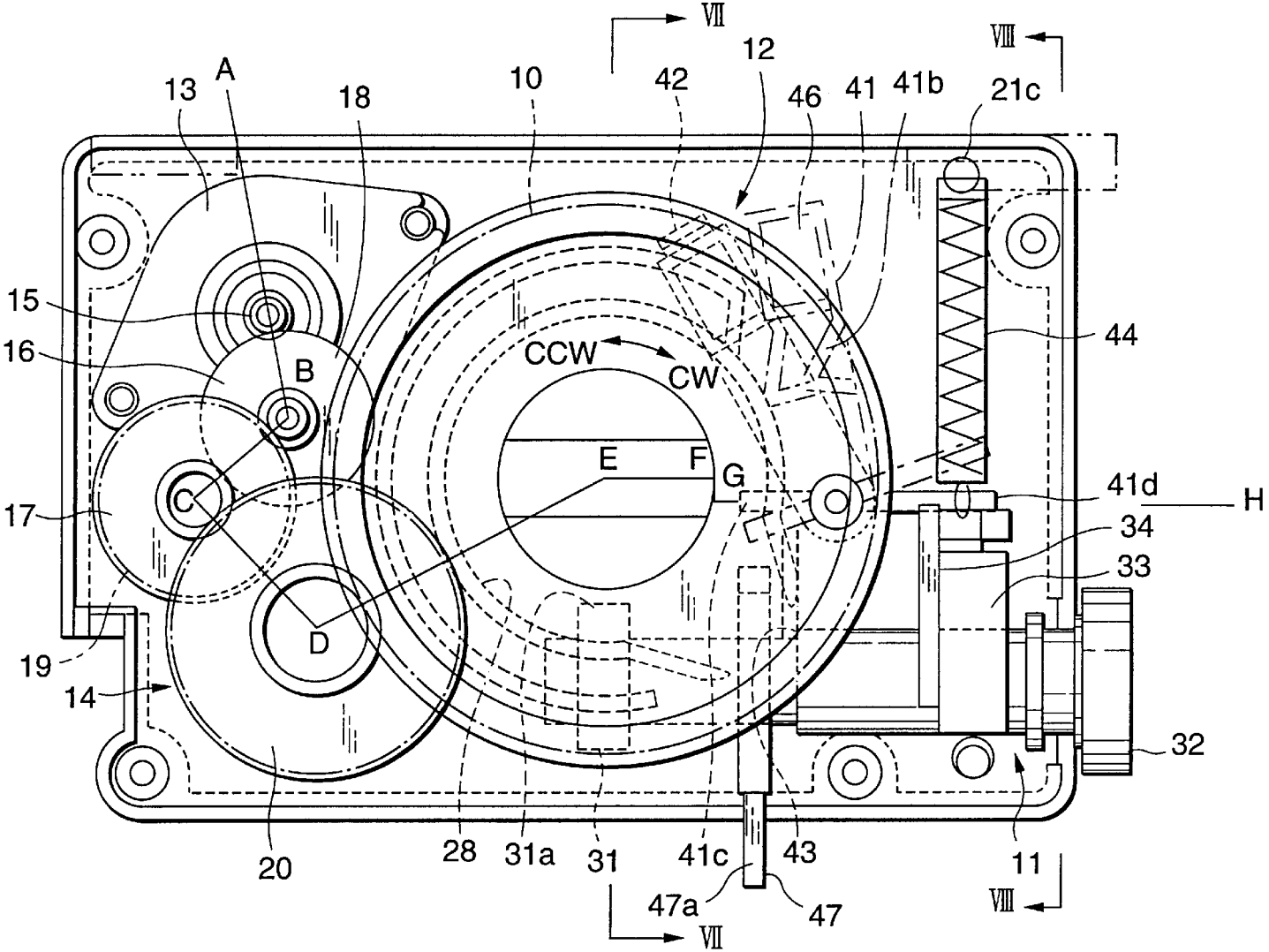
FIG. 4 is a front view showing a driver unit of the FIG. 1, one of the cases being removed for ease of observation.
Figure 5:
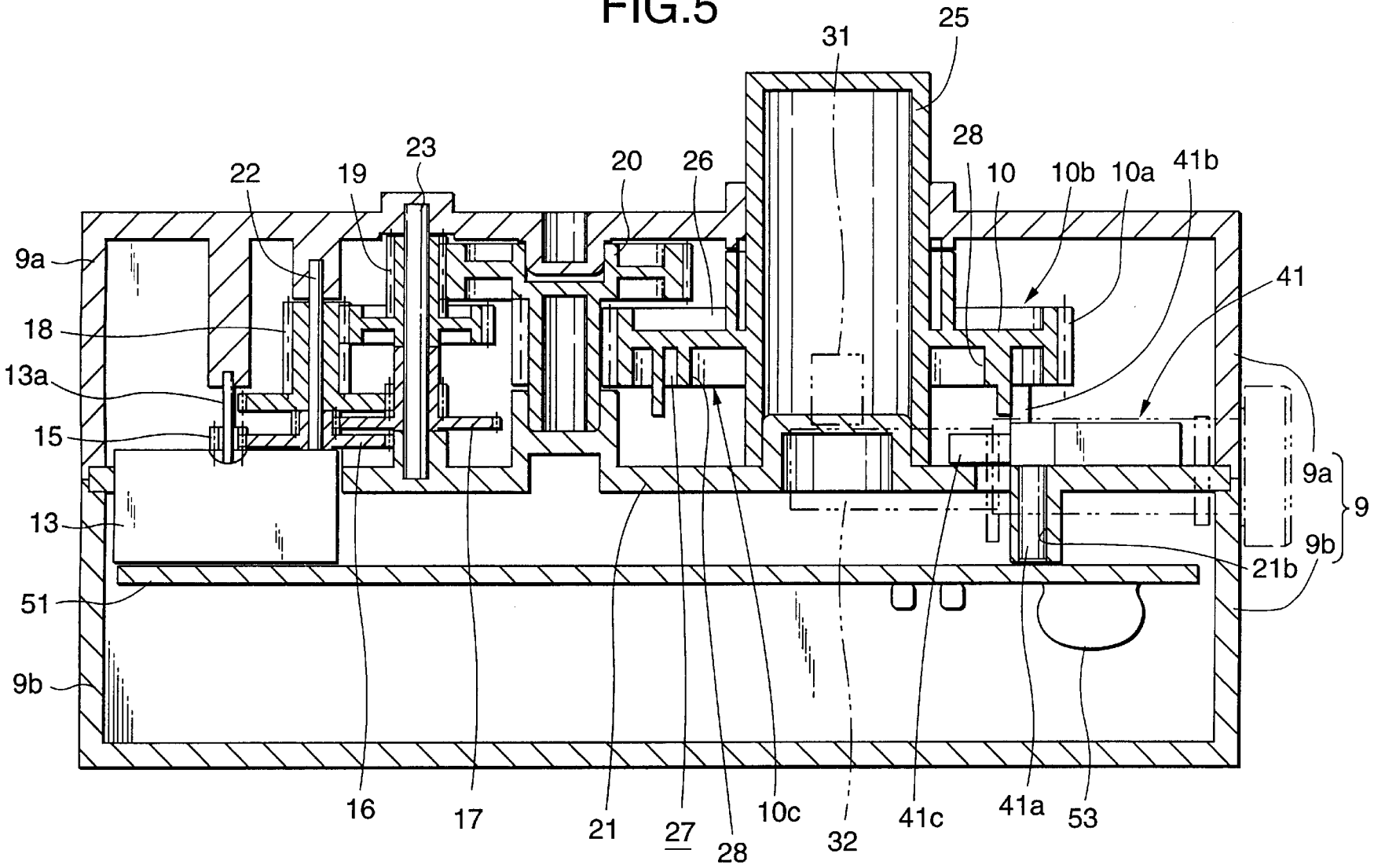
FIG. 5 is a development showing the FIG. 4 driver unit taken along line A, B, C, D, E, F, G and H, the view showing a coupling mechanism of a rotation transmitting means of the driver unit.

The driver unit 5, as shown in FIGS. 4 and 5, is made up of a cam gear 10, an ice-detecting mechanism 11 and a switch mechanism 12. The cam gear 10 provides a cam, coupled with the icetray 2, for reversing the ice tray. The ice-detecting mechanism 11 and the switch mechanism 12, both being operated by the cam gear 10, partly form an interposed member. The innards of the driver unit 5 are covered with a case 9, which consists of two cases 9*a* and 9*b*.

The cam gear 10 is rotated by a stepping motor 13 as a drive source. A rotation of the stepping motor is transmitted to the cam gear 10 by way of rotation transmitting means. The rotation transmitting means is formed with a pinion 15 coupled to the rotor output shaft 13*a* of the stepping motor 13, and a reduction gear train for successively reducing a rotation speed of the pinion 15. The reduction gear train consists of first to fifth gears 16 to 20.

As shown in FIG. 5, the first gear 16 and the third gear 18, while the latter being located above the former, are rotatably coupled to a fixed shaft 22 provided between the first case 9*a* and end face of the motor. Each of those gears 16 and 18 consists of a gear portion of the large diameter and a pinion portion of the small diameter. The second gear 17 and the fourth gear 19, while the latter being located above the former, are rotatably coupled to a fixed shaft 23 provided between the first case 9*a* and a middle position base plate 21. Each of those gears 17 and 19 consists of a gear portion of the large diameter and a pinion portion of the small diameter.

The gear portion of the second gear 17 is in mesh with the pinion portion of the first gear 16; the pinion portion of the second gear 17 is in mesh with the gear portion of the third gear 18; the pinion portion of the third gear is in mesh with the gear portion of the fifth gear 20; and the pinion portion of the fifth gear 20 is in mesh with the gear 10*a* of the cam gear 10. With this mechanical coupling, a rotation of the rotor output shaft 13*a* of the stepping motor 13 is transmitted to the cam gear 10 while being successively reduced in speed.

Figure 6A:
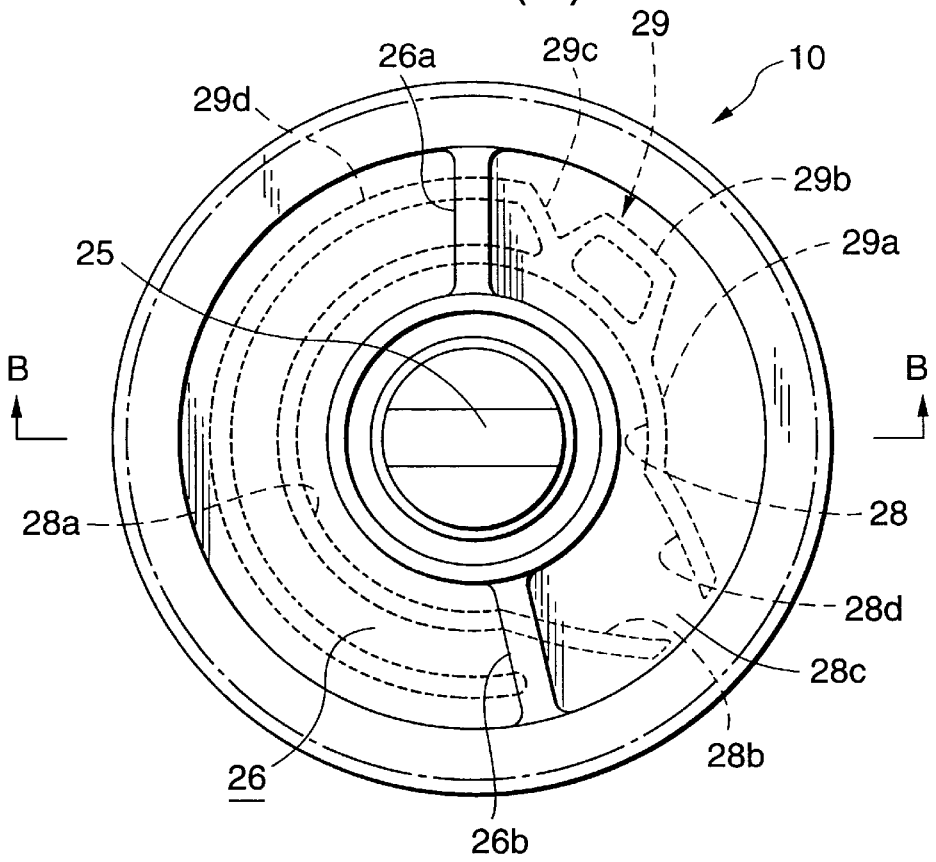
FIG. 6A is a plan view showing a cam gear in the FIG. 4 driver unit, and 6B is a cross sectional view taken on line B—B in FIG. 6A.
Figure 6B:
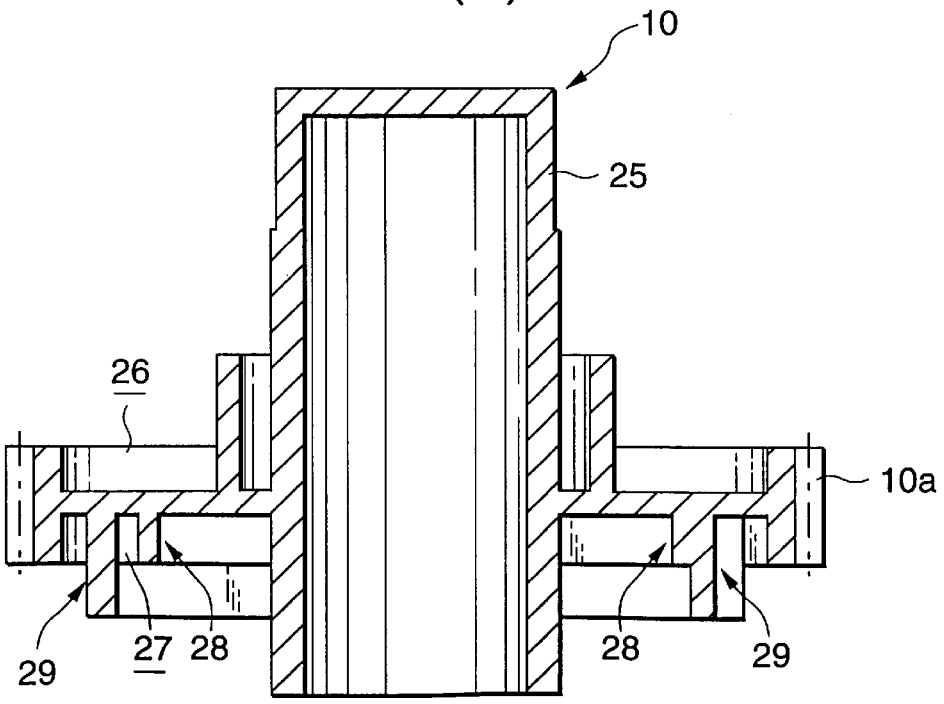
Figure 7:
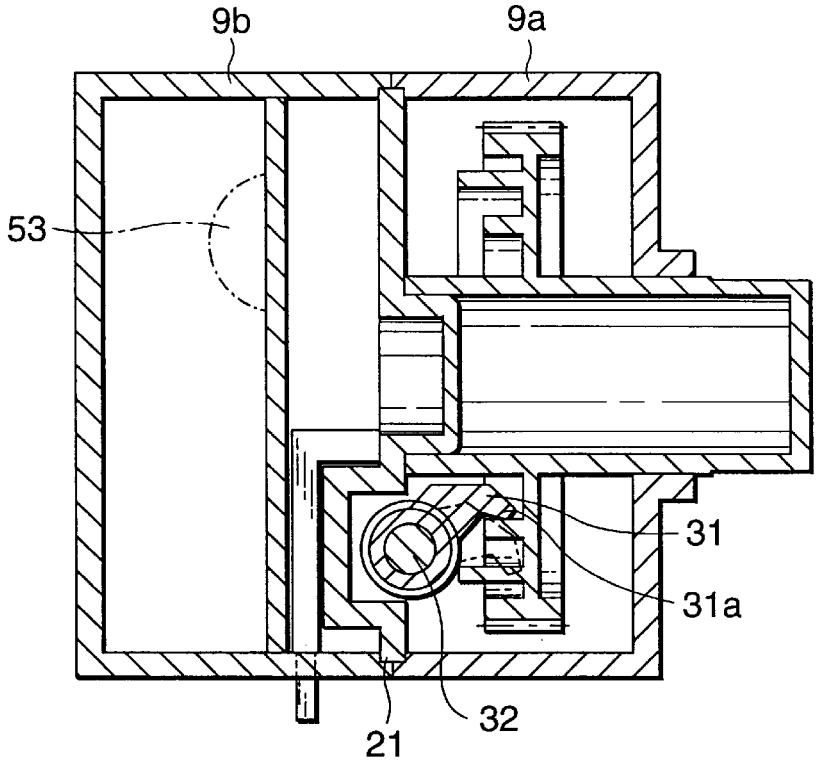
FIG. 7 is a cross sectional view showing a key portion of the 4 driver unit taken on line VII—VII in FIG. 4.
Figure 8:
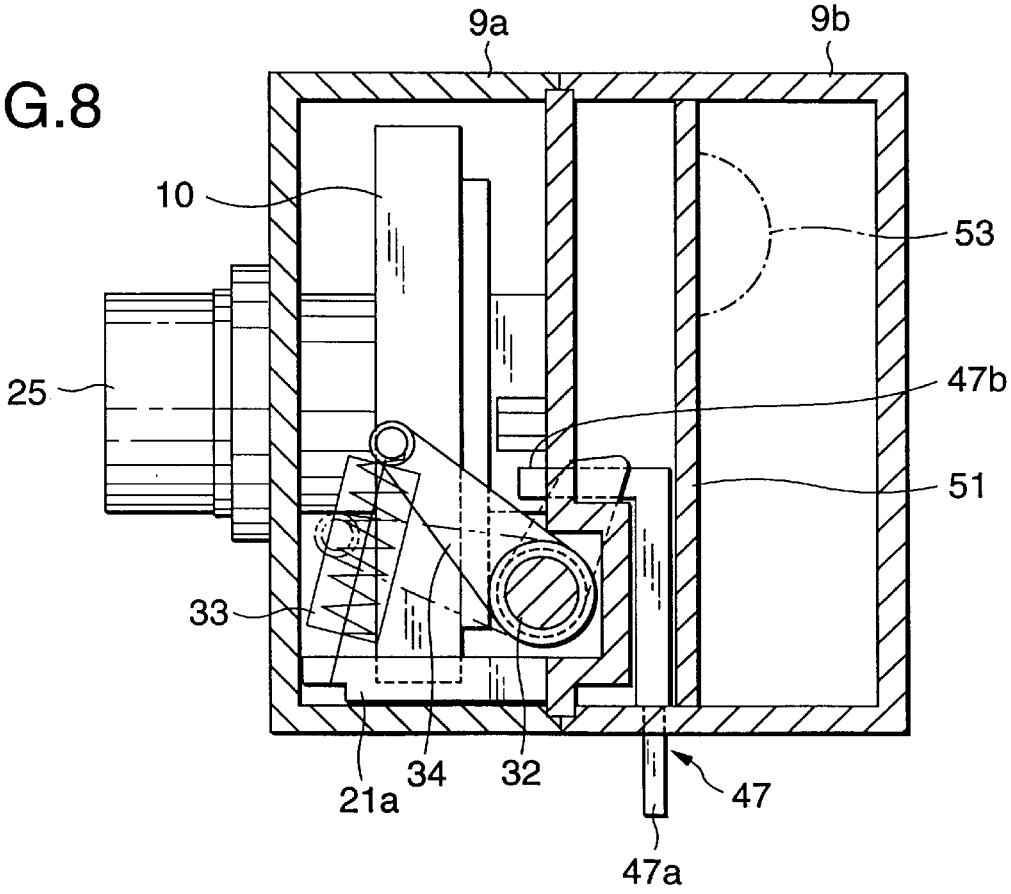
FIG. 8 is a cross sectional view showing a key portion of the 4 driver unit taken on line VIII—VIII in FIG. 4.
Figure 9:
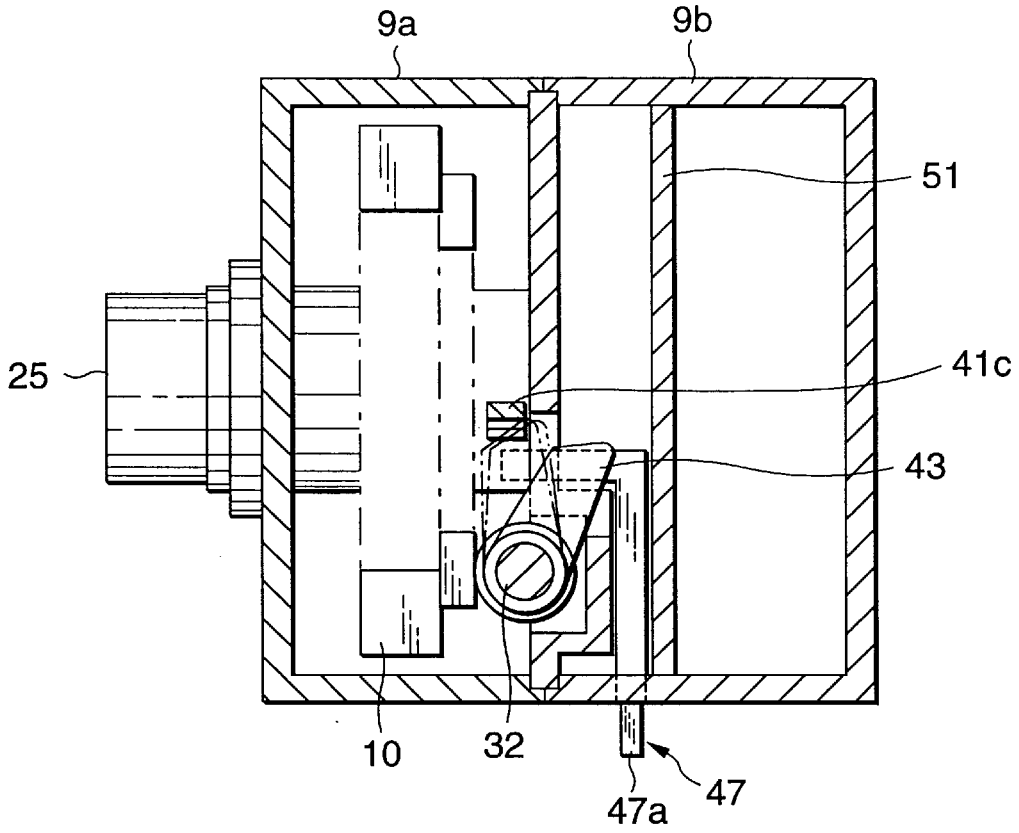
FIG. 9 is a cross sectional view showing a key portion of the 4 driver unit taken on line IX—IX in FIG. 4.
Figure 10:
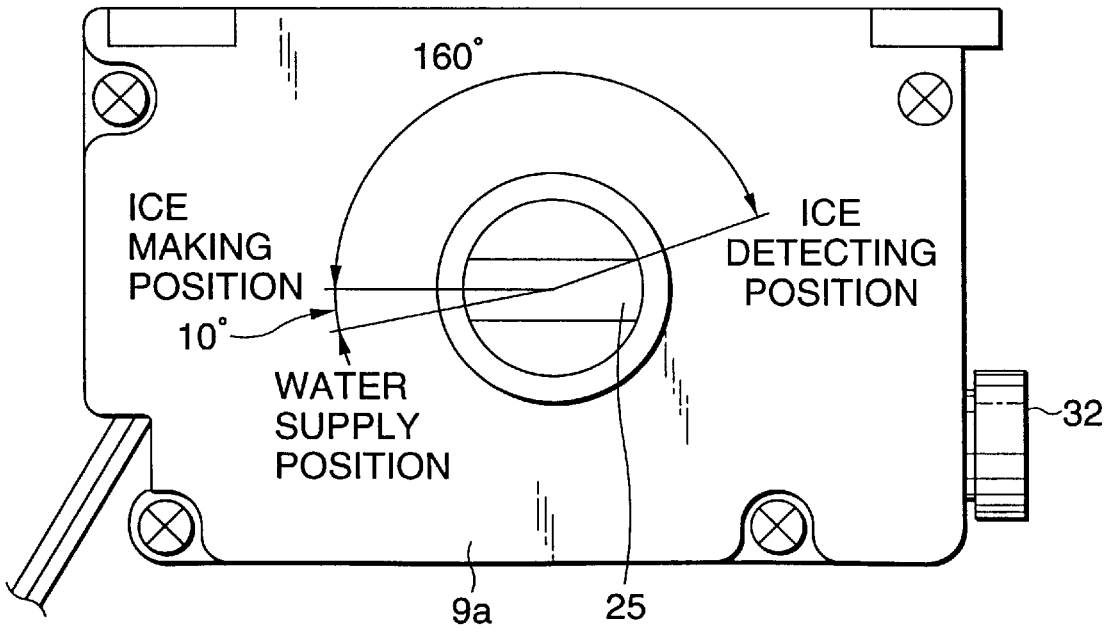
FIG. 10 is a plan view showing a driver unit portion of the FIG. 1 automatic ice making machine.

FIG. 6 schematically shows the cam gear 10. The cam gear 10 is integral with the output shaft 25. The output shaft 25 is extended out of the driver unit 5 through a hole of the first case 9*a* of the case, and coupled to the ice tray 2. Therefore, the cam gear 10 and the ice tray 2 are rotated in unison.

A groove 26, while circumferentially extending, is formed in a first broad surfaces 10*b* of the gear 10*a*, which faces the first case 9*a*. A protrusion (not shown) formed on the inner surface of the first case 9*a* is inserted into the groove 26, to thereby limit a range within which the cam gear 10 may be turned to a given angular range. The rotation of the cam gear 10 is limited at the positions (rotation limit positions) where the protrusion of the first case comes in contact with both end faces 26*a* and 26*b* of the groove 26. In the embodiment, the rotation of the cam gear 10 is limited to within an angular range from −20° to 170°. This range is a tolerable range provided for an accidental situation where the stepping motor 13 is out of order. Usually, the angular range is selected to be between −10° to 160°, as will be described later.

An annular groove 27 is formed in a second broad surface 10*c* of the cam gear 10, which faces the middle position base plate 21. An inner wall of the annular groove 27, closer to the center of rotation of the annular groove 27, forms a first cam face 28 for the ice detecting shaft, while another inner wall of the annular groove, closer to the outer circumference of the annular groove, forms a second cam face 29 for the magnet lever. The first and second cam faces 28 and 29 are formed on the side walls of the portions, which are extended substantially parallel to the shaft of the cam gear 10 located at the center of rotation of the cam gear.

The first cam face 28 includes an ice-detecting non-operation part 28*a*, an ice-detecting descending part 28*b*, an insufficient-ice detecting part 28*c*, and an ice-detecting return part 28*d*. The insufficient-ice detecting part 28*c* shows a free space defined between the ice-detecting descending part 28*b* and the ice-detecting return part 28*d*. A protruded portion 31*a* of the ice-detecting-shaft lever 31 described hereinafter moves along the free space. The second cam face 29 includes a first on-signal generating cam part 29*a*, a first off-signal generating cam part 29*b*, a full-ice on-signal generating cam part 29*c* as a second on-signal generating part, and a second off-signal generating cam part 29*d*.

The ice-detecting mechanism 11 is formed with an ice-detecting-shaft lever (transmitting means) 31 operated by the cam gear 10, an ice-detecting shaft 32 for transmitting a motion of the ice-detecting-shaft lever 31 to the ice detecting arm 3, a coiled spring 33 for generating a force to turn the ice-detecting shaft 32, and an arm 34 on which the coiled spring 33 is mounted.

The ice-detecting-shaft lever 31 is disposed between the cam gear 10 and the middle position base plate 21. A protruded portion 31*a* is provided at one end of the ice-detecting-shaft lever 31, while facing the first cam face 28. The protruded portion 31*a* is located at a position radially spaced from the center of rotation of the ice-detecting-shaft lever 31, and rotatable about the center of rotation. The protruded portion 31*a* serves as a cam follower to be in contact with the first cam face 28 of the cam gear 10.

The ice-detecting mechanism 11 thus constructed transmits a motion of the ice-detecting-shaft lever 31 to the ice detecting arm 3. The ice-detecting shaft 32 moves along the first cam face 28. The mechanism 11 further transmits a motion of the ice detecting arm 3 to a magnet-swing prohibiting member 43 to be given later. When the ice-storage container becomes full of ice cubes and the ice detecting arm 3 stops its motion, the ice-detecting shaft 32 and ice detecting arm 3 as well stop their rotation.

The coiled spring 33 is hooked at one end to a protruded piece 21*a* of the middle position base plate 21, so that the ice detecting arm 3 is constantly urged to the ice-detecting position; the coiled spring generates such an urging force as to bring the ice-detecting-shaft lever 31 into contact with the first cam face 28 for the ice-detecting shaft. The urging force is directed from the center to the outer circumference of the cam gear 10, and its strength is so selected as not to hinder the assembling of both the cases 9*a* and 9*b*. As a result, the cam gear 10 is not raised by the urging force of the coiled spring 33, the assembling of the cam gear 10 is easy, and it is easy to unit the cases 9*a* and 9*b*, and hence easy assembling work is secured.

The switch mechanism 12 as signal outputting means is made up of a magnet lever 41, a Hall sensor 42, the magnet-swing prohibiting member 43, and a coiled spring 44. The magnet lever 41 forms signal varying means operated by the cam gear 10. The Hall sensor 42 forms position detecting means for varying a detecting signal with a rotation of the magnet lever 41. The magnet-swing prohibiting member 43 prevents the magnet lever 41 from turning. The coiled spring 44 generates a force to turn the magnet lever 41.

The magnet lever 41 is disposed between the first case 9*a* and the middle position base plate 21, and its shaft portion 41*a* is coupled to a through-hole 21*b* of the middle position base plate 21 in a state that it may be swung. An outward-curved portion 41*b* is formed on the surface of one end of the magnet lever 41, which is closer to the cam gear 10. The outward-curved portion 41*b* serves as a cam follower to be in contact with the second cam face 29 (for the magnet lever) of the cam gear 10. Therefore, when the cam gear 10 is rotated, the outward-curved portion 41*b* moves along the second cam face 29 in the radial direction of the cam gear 10, and the magnet lever 41 turns.

An arm 41*c* serving as a pressed portion is provided at a given position on the magnet lever 41. The arm 41*c* is disposed in the vicinity of the magnet-swing prohibiting member 43 of the ice-detecting shaft 32. In a state that the magnet-swing prohibiting member 43 is in contact with the arm 41*c*, the magnet lever 41 is locked. A magnet 46 for operating the Hall sensor 42 is attached to the tip of the magnet lever 41. The magnet lever 41 includes an arm 41*d*, which is disposed symmetrically with the arm 41*c* with respect to a point. One end of the coiled spring 44 is coupled to the arm 41*d*. The other end of the coiled spring 44 is hooked to a shaft 21*c* of the middle position base plate 21.

An operating member 47 is provided so as to come in contact with the arm 41*c* of the magnet lever 41. The operating member 47 is slidable between the middle position base plate 21 and a printed circuit board 51 to be given later. The operating member 47 includes an operation portion 47*a* for manual operation and a contact portion 47*b* to be in contact with the arm 41*c*. The operating member is urged to the outside of the case 9 by means of a spring (not shown), located between the first case 9*a* and the contact portion 47*b*.

The operating member 47 is used for the following cases: 1) to check the operation of the driver unit 5 after it is assembled, 2) to check the operation of the automatic ice making machine 1 after it is assembled into a refrigerator, and to discharge water out of the ice tray 2 when the refrigerator is moved to another place. When the operating member 47 is manually pushed, the magnet lever 41 and then stepping motor 13 are operated to set the ice tray 2 at the ice making position and the ice separation position, and to return it to the ice making position, and to check the operation of the automatic ice making machine 1, and to discharge the ice cubes and/or water out of the ice tray 2.

The Hall sensor 42 is connected to the printed circuit board 51 that is mounted between the middle position base plate 21 and the second case 9*b* of the case 9. The Hall sensor 42 is disposed such that when the magnet lever 41 is at the operation position, the Hall sensor 42 confronts the magnet 46 of the magnet lever 41.

Figure 11:
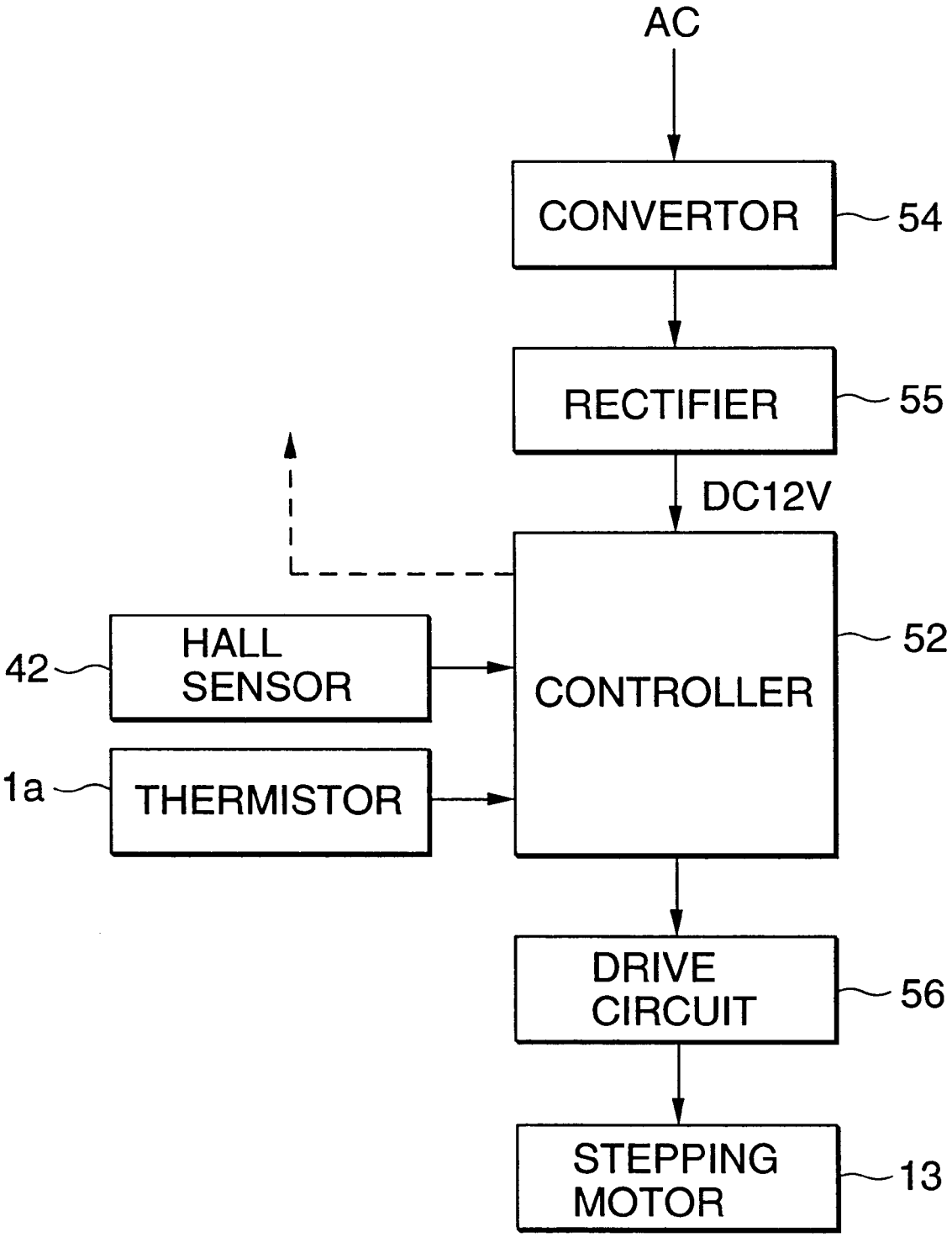
FIG. 11 a block diagram showing a control system of the FIG. 1 machine.

The Hall sensor 42 is electrically connected to a controller 52 as signal detecting means as shown in FIG. 11. When the magnet lever 41 is at a non-operation position, the Hall sensor 42 generates a signal in a low level (referred to as an L signal) for transmission to the controller 52. When the magnet lever 41 is turned and its magnet 46 confronts the Hall sensor 42, the Hall sensor 42 generates a signal in high level (referred to as an H signal) for transmission to the controller 52.

The Hall sensor 42 generates an H signal at two positions during a rotation of the cam gear 10 in a range from −15° to 160°. As recalled, the second cam face 29 for operating the magnet lever 41 includes the recesses at two locations, the first on-signal generating cam part 29*a* and the full-ice on-signal generating cam part 29*c*. Every time the outward-curved portion 41*b* reaches those cam parts and the magnet lever 41 turns, the Hall sensor 42 produces an H signal. The H signal is recognized as an ice making position signal or an ice-detecting position signal (identifying signal), which depends on its generating position, by the controller 52. The controller 52 recognizes the current position of the cam gear 10 depending on the contents of the H signal.

Various kinds of electronic parts 53 for a control circuit including the controller 52 are attached to a portion of the printed circuit board 51, which is closer to the second case 9*b*. While the control circuit including the controller 52 is provided in the automatic ice making machine 1, it may be included a circuitry of the refrigerator into which the automatic ice making machine 1 is assembled.

The magnet lever 41 is urged toward the second cam face 29 by means of the coiled spring 44. The urging force is directed from the center to the outer circumference of the cam gear 10, and its strength is so selected as not to hinder the assembling of both the cases 9*a* and 9*b*. Therefore, the cam gear 10 is not raised by the urging force of the coiled spring 33, the assembling of the cam gear 10 is easy, and it is easy to unit the cases 9*a* and 9*b*, and hence easy assembling work is secured.

The controller 52 contains a microcomputer, and forms control means serving as measuring means and comparing means. As shown in FIG. 11, a power source at 100V or 120V is processed into a power source at DC 12V by a converter 54 and a rectifier 55. The controller 52 is connected for reception with the thermistor 1*a* and the Hall sensor 42, and for transmission with a drive circuit 56 and then the stepping motor 13. The controller 52 further contains a timer circuit. A memory device contained in the controller 52 stores a basic operation program and an initializing program. The controller 52 receives a detecting signal of the Hall sensor 42, for example. The controller 52 repeatedly executes those related control programs in accordance with detecting signal to turn the stepping motor 13 forwardly or reversely.

As stated above, the controller 52 forms control means. The controller 52 can produce a signal for controlling other devices, for example, an electromagnetic valve used for supplying water to the reservoir tank 8*b*, and a signal for controlling the valve 8 when the swing member 4 is not used. The controller 52 constantly checks whether or not the ice tray 2 is moving, the current position of the ice tray 2, and others.

Figure 12:
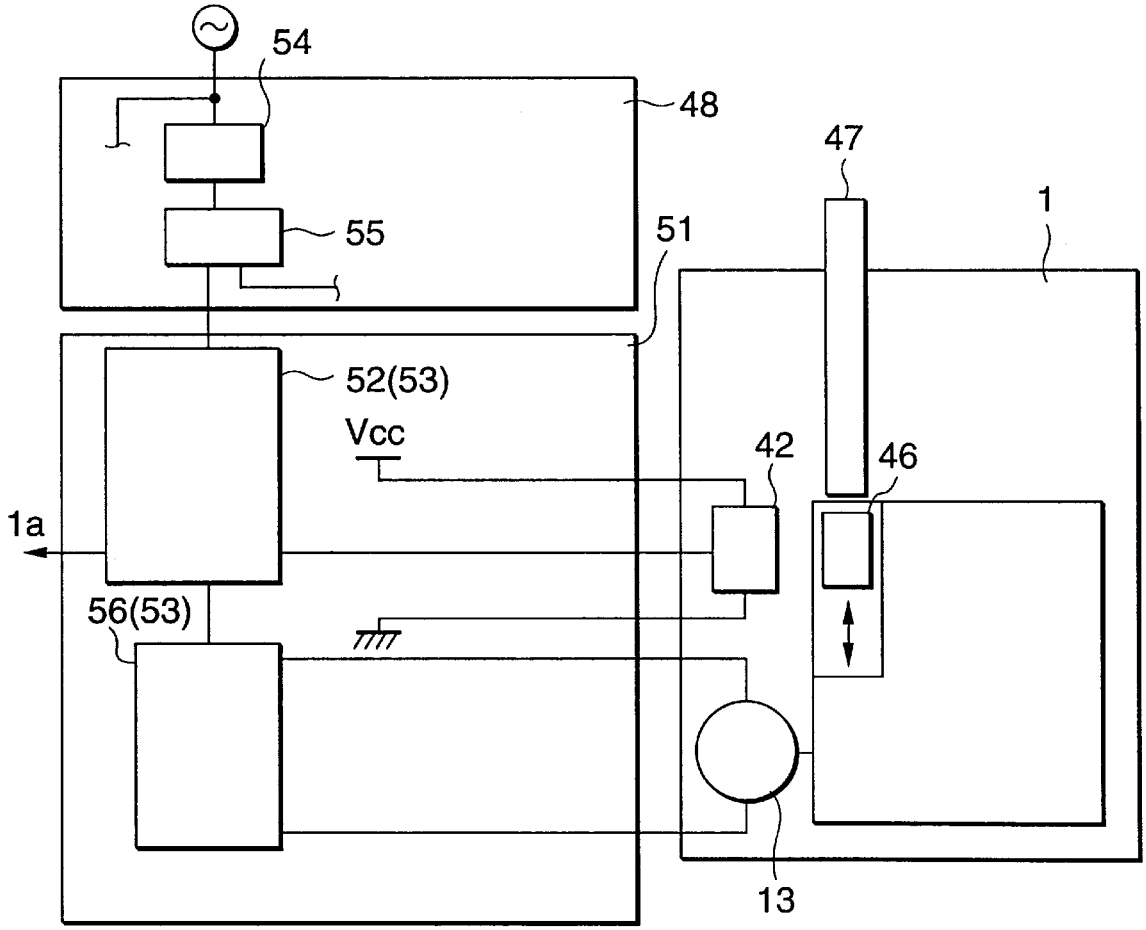
FIG. 12 is a diagram showing a basic electrical connection concerning the automatic ice making machine of FIG. 1.

A basic electrical arrangement concerning the automatic ice making machine 1 is as shown in FIG. 12. As shown, the controller 52 on the printed circuit board 51 is connected to a control board (including circuitry portions) of the main body of the refrigerator. Normally, the magnet lever 41 of the automatic ice making machine 1 is operated through the rotation of the stepping motor 13 to displace the magnet 46, viz., to vary a signal relative position. Through the displacement of the magnet 46, the Hall sensor 42 produces signals for transmission to the controller 52. The controller 52 knows the current position of the ice tray 2 from the signals, and controls the ice tray 2 properly. If required, the signal relative position may also be varied by manually operating the operating member 47 and displacing the magnet lever 41.

The controller 52 may be formed in the control board 48 of the main body of the refrigerator, while it is formed in the printed circuit board 51 of the automatic ice making machine 1 in the embodiment. In this case, the converter 54, the rectifier 55, the controller 52 and the drive circuit 56 are mounted on the control board 48.

Next, an operation of the automatic ice making machine 1 will be described. The controller 52 performs the basic operation program and the initializing program and operates as show in FIGS. 13 and 14. The controller 52 starts to execute the basic operation program when an AND condition of a fact that the door of the refrigerator is not opened, and another fact that a preset time has elapsed after the thermistor la located under the ice tray 2 had detected the completion of the ice making operation is satisfied, and the controller 52 receives a stand-by end signal. The controller 52 starts to execute the initializing program when it receives a power-on signal or an initializing signal.

Figure 14:
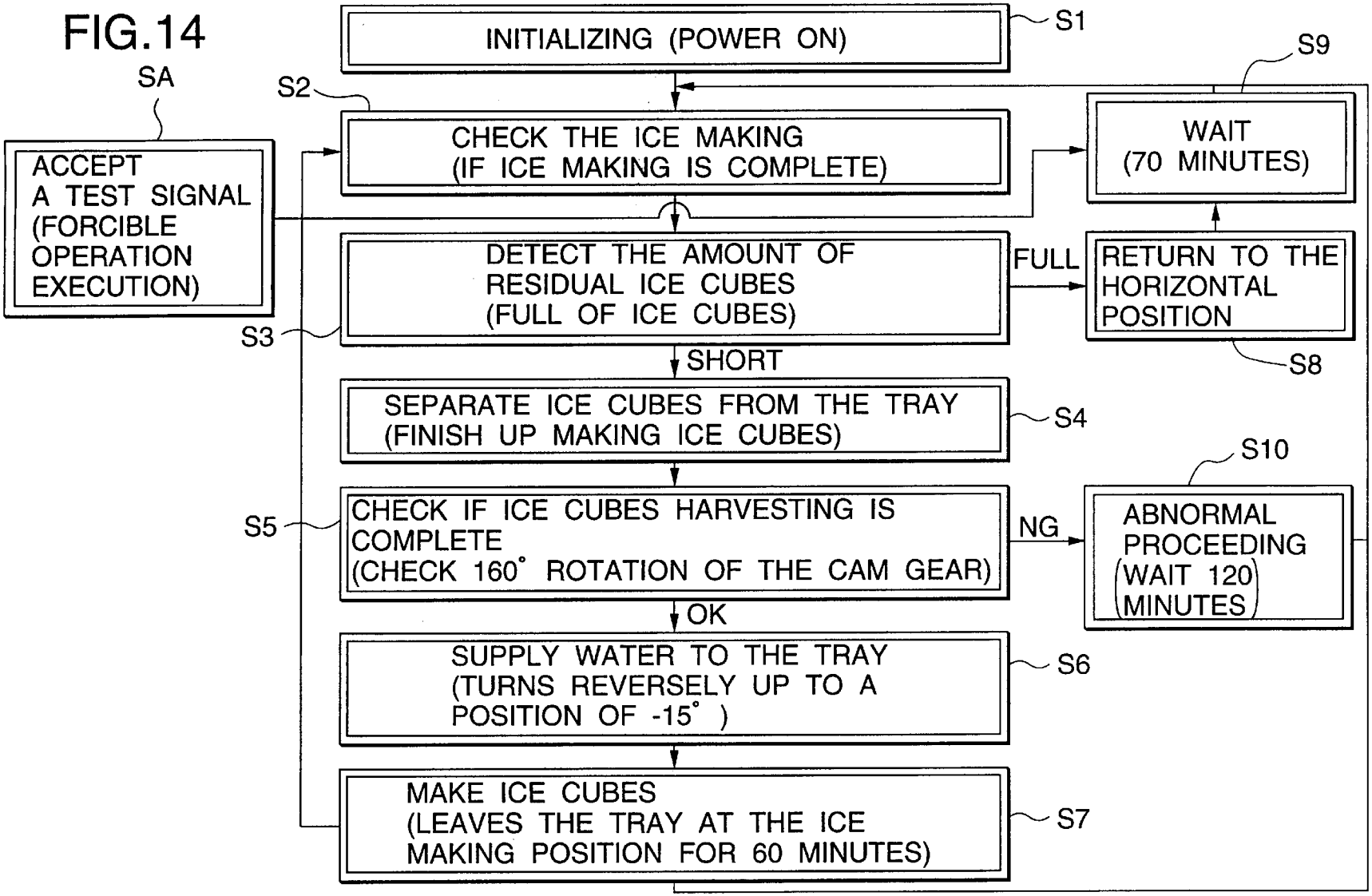
FIG. 14 is a flow chart showing a general control process executed by a controller of the FIG. 1 automatic ice making machine.

An overall operation of the automatic ice making machine 1 is as shown in FIG. 14. Upon power on, the initializing program starts to run (step S1). Then, the controller executes the basic operation program and enters an ice making completion check, viz., as to if the ice making is complete (step S2). The controller 52 checks as to if the ice making operation is completed by use of the thermistor 1*a*. In this case, if temperature of the ice tray is lower than a predetermined temperature, the controller judges that the ice making operation is completed, and the controller detects an amount of ice cubes in the ice storage container (step S3). When the process execution starts from the initializing program, the ice tray 2 is empty, but the thermistor 1*a* detects temperature of the ice tray irrespective of ice cubes being present or absence, and hence determined that the ice making is complete, and advances to a step S3.

In the step S3, the controller 52 checks as to whether the ice storage container is full or short of ice cubes. If it is short of ice cubes, it rotates the tray in the opposite direction to eject ice cubes from the tray into the ice storage container (viz., to effect harvesting of ice cubes) (step S4). The controller checks as to if the ice separation is performed, viz., the cam gear 10 is turned through an angle of 160° (step S5). If it is rotated so, the controller rotates the cam gear in the reverse direction up to a position of −150°, and supplies to the ice tray (step S6). Then, the ice tray 2 is returned to the horizontal position, viz., to be horizontal in attitude, and ice cubes are formed therein.

In the step S3, if the ice storage container is full of the ice cubes, the ice tray 2 is returned to be the horizontal position without being reversed (step S8), and waits for a predetermined time for detecting the amount of the residual ice cubes (step S9), and returns to the step S2 (ice-making check). If the ice tray 2 is not turned 160°, the controller executes an abnormality process, viz., waits for a predetermined time (step S10) and returns to the step S2.

When the ice tray 2 stops at the ice making position (=horizontal position), the controller 52 is put in a state that it can accept a change of the signal, caused by the operating member 47. Specifically, the controller 52 accepts a signal only when the operating member 47 is operated in the steps S2, S7 and S9, and executes a forcible-operation execution process (step SA) upon receipt of a test signal. As the result of the forcible drive, the ice tray 2 is moved to the ice detecting position, ice separation position, water supply position and ice making position, and the ice detecting arm 3 is operated for ice detecting, for example.

Figure 15:
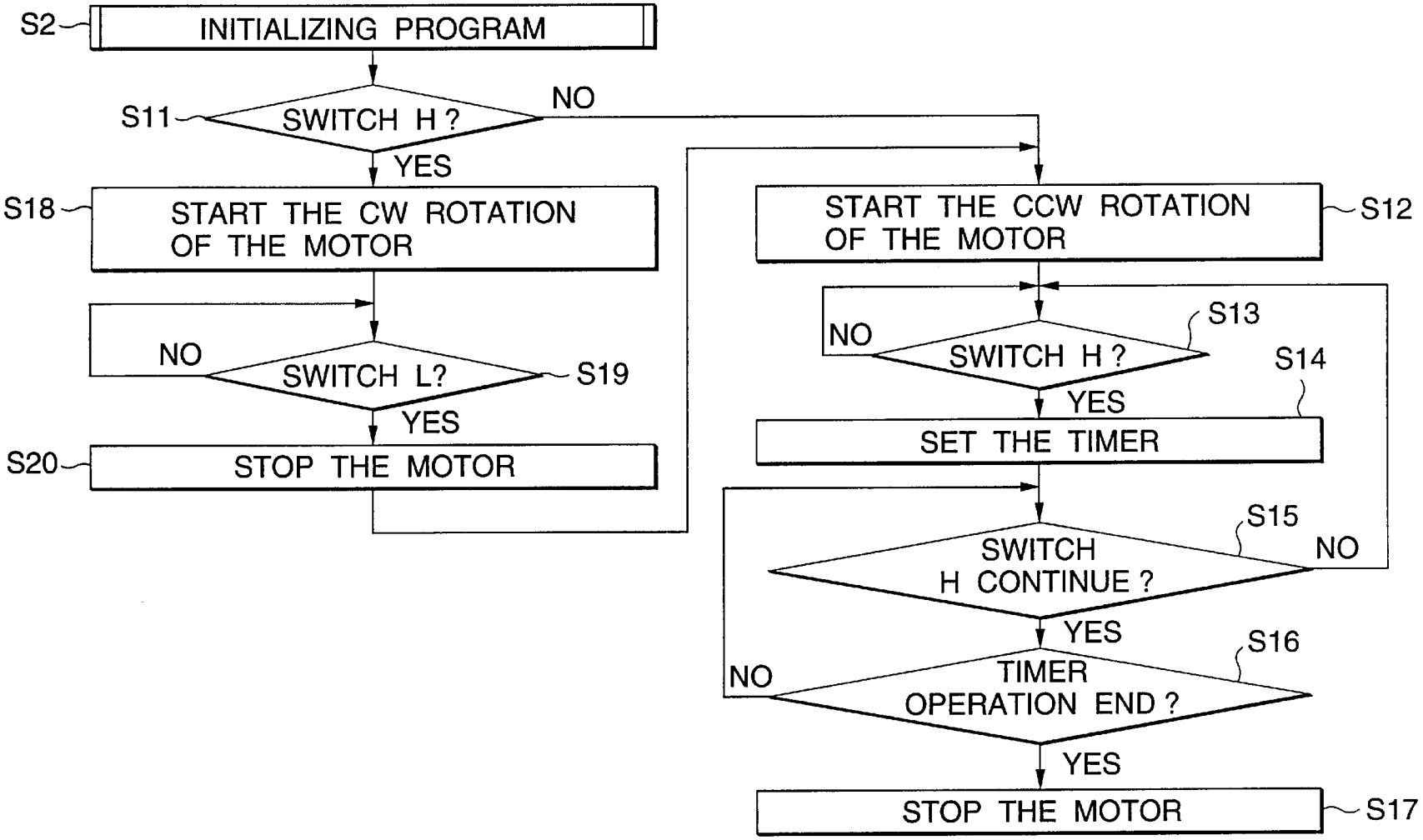
FIG. 15 is a flow chart showing an initializing program executed by the controller.

The initializing program may be flow charted as shown in FIG. 15. In the description to follow, the positional relationship of the magnet lever 41 and the Hall sensor 42 are each divided into two states, "switch H" and "switch L", depending on their generating signals. In this program, a state of the magnet lever 41 is first detected. Specifically, the controller 52 judges whether or not the switch outputs an H signal (step S11); if the answer is NO, the stepping motor 13 is rotated in the reverse direction (counterclockwise direction=CC) and the cam gear 10 is rotated toward the ice making position (step S12).

Thereafter, the controller 52 detects whether or not the switch produces an H signal (step S13); if the answer is YES, it sets a timer (step S14). In this case, a timer time is selected to be a time tb, which is longer than a full-ice on-signal time ta, or time taken when the cam gear angularly moves from the reference position to the ice making position; the reference position is selected so as to satisfy a relation tb>ta. The timer time is set in terms of the number of steps by which the stepping motor 13 is rotated.

While the timer operates, the controller 52 checks whether or not the switch continues the outputting of the H signal (step S15); if the answer is YES, it checks as to if the timer operation ends (step S16); and if the answer is YES, it stops the stepping motor 13 (step S17). When the switch still produces the H signal at the end of the timer operation, the controller 52 judges that the H signal is not a full-ice on signal but is an on signal at the ice making position, and stops the stepping motor 13 in its operation. Thus, when the on signal continues for an angular width sufficiently longer an output angular width (=approximately 7°) of the full-ice on signal, the controller judges that the H signal is an origin output signal. The time point where the timer operation ends is set as an ice making position (this time point=time point at which the motor is rotated by a predetermined number of steps, and=a position to which the ice tray is reversely rotated 15° in the direction opposite to the ice making position).

As a result, the cam gear 10 is set at the position of 0°. The ice tray 2 is placed at the horizontal position. When the switch produces an L signal within the timer time in the step S15, the position where the H signal is detected is the full-ice on signal generation position. Therefore, in order to detect the next H signal, the controller causes the stepping motor 13 to continue the CCW rotation.

When the switch produces an H signal in the step S11, the stepping motor 13 is rotated in the forward direction (clockwise direction=(CW) direction), and it rotates the cam gear 10 toward the ice separation position (step S18). The reason why the motor is rotated in this direction follows. The automatic ice making machine 1 of the embodiment is designed such that when it is further rotated in the reverse direction beyond the ice making position, it is shifted to the water supply position, and water is automatically supplied to the tray. If the water supply is carried out during the execution of the initializing program, water will be supplied to the ice tray 2 being full of water or ice cubes. To avoid this, water supply is prohibited during the execution of the initializing program.

After the stepping motor 13 starts the CW rotation (step S18), the controller 52 checks as to if the switch generates an L signal (step S19); if the answer is YES, it stops the stepping motor 13 for one second (step S20). Thereafter, the controller goes to the step S12 and rotates the stepping motor in the CCW direction. Subsequently, the controllers repeats the steps S13 to S17, checks the origin signal, and rotates the cam gear 10 to the position of 0°. Incidentally, the stepping motor 13 is rotated at 600 pps in the initializing mode.

Figure 17:
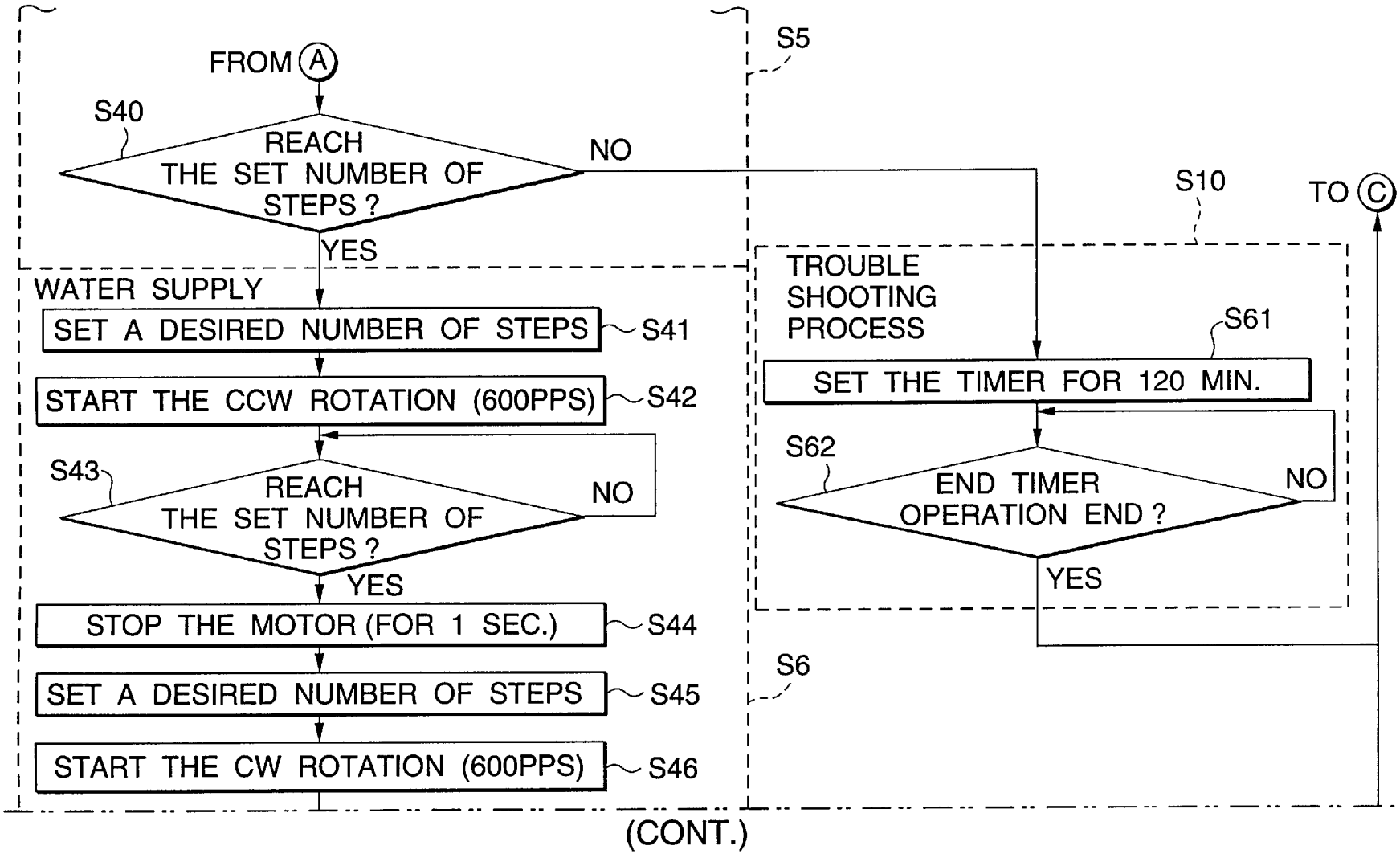
FIG. 17 is a flow chart showing the second half of the basic operation program.
Figure 18:
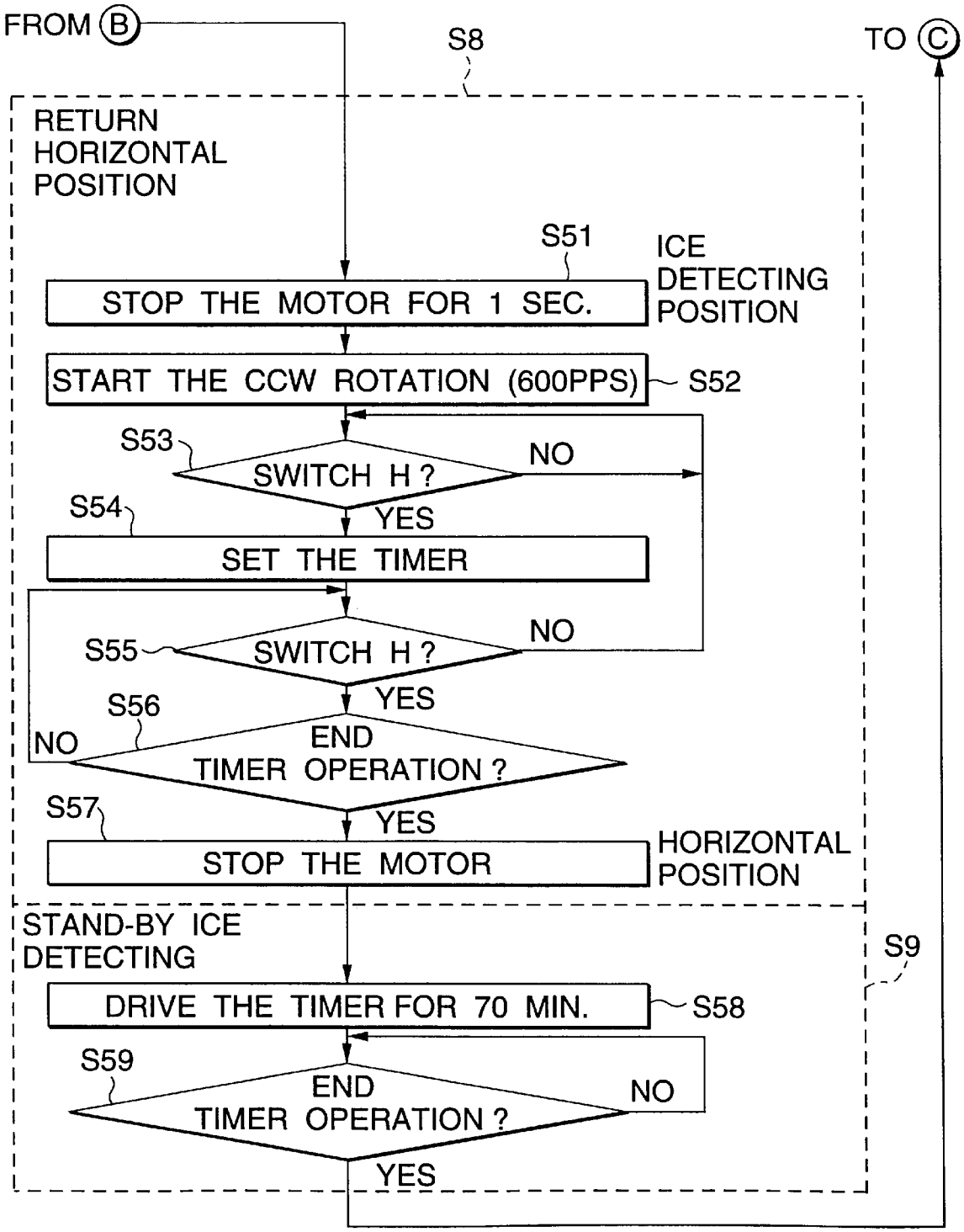
FIG. 18 is a flow chart showing a portion of the basic program, branched from the FIG. 16 flow chart.

Next, the basic operation program will be described referring to FIGS. 16 through 18.

Figure 20:
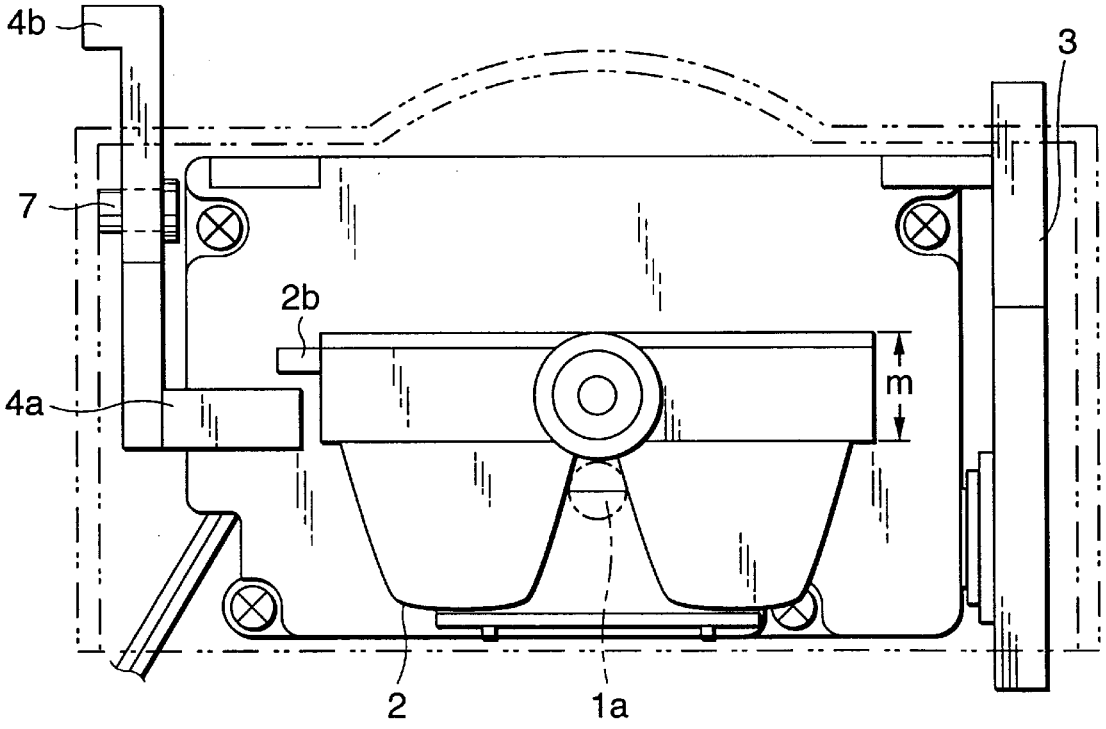
FIG. 20 is a side view showing an ice making position state of an ice tray in the FIG. 1 machine.

When the basic operation program is not performed, the cam gear 10 is at the ice making position (rotation angle=0°). In this state, the ice tray 2 is held horizontally as shown in FIG. 20. Further, the first cam face 28 for operating the ice-detecting mechanism 11 has moved the protruded portion 31*a* to the center of the cam gear 10, and retracted the ice-detecting shaft 32 to the non-operation position.

In this state, the ice detecting arm 3 is stored in near to the side of the ice tray 2, as indicated by a solid line in FIG. 2. The outward-curved portion 41*b* of the magnet lever 41 in the switch mechanism 12 moves along the second cam face 29 radially inwardly, and the magnet-swing prohibiting member 43 is separated from the arm 41*c*. Therefore, the magnet lever 41 is brought into contact with the recess of the second cam face 29 by the spring force of the coiled spring 44, and may be turned.

After the initialization of the step S1, the ice tray 2 stands by at the ice making position and the controller executes the step S2 for ice making check. To begin with, the controller 52 checks as to if the tray is at a predetermined temperature (−8° C. or lower in the embodiment) (step S21); if the answer is YES, it drives the timer to start in operation (step S22). Then, the controller checks as to if the set time has elapsed (step S23). If the set time (10 minutes in the embodiment) has elapsed, the controller checks as to if the ice tray 2 is at a predetermined temperature (12° C. in the embodiment) by use of the thermistor 1*a* (step S24).

Figure 13:
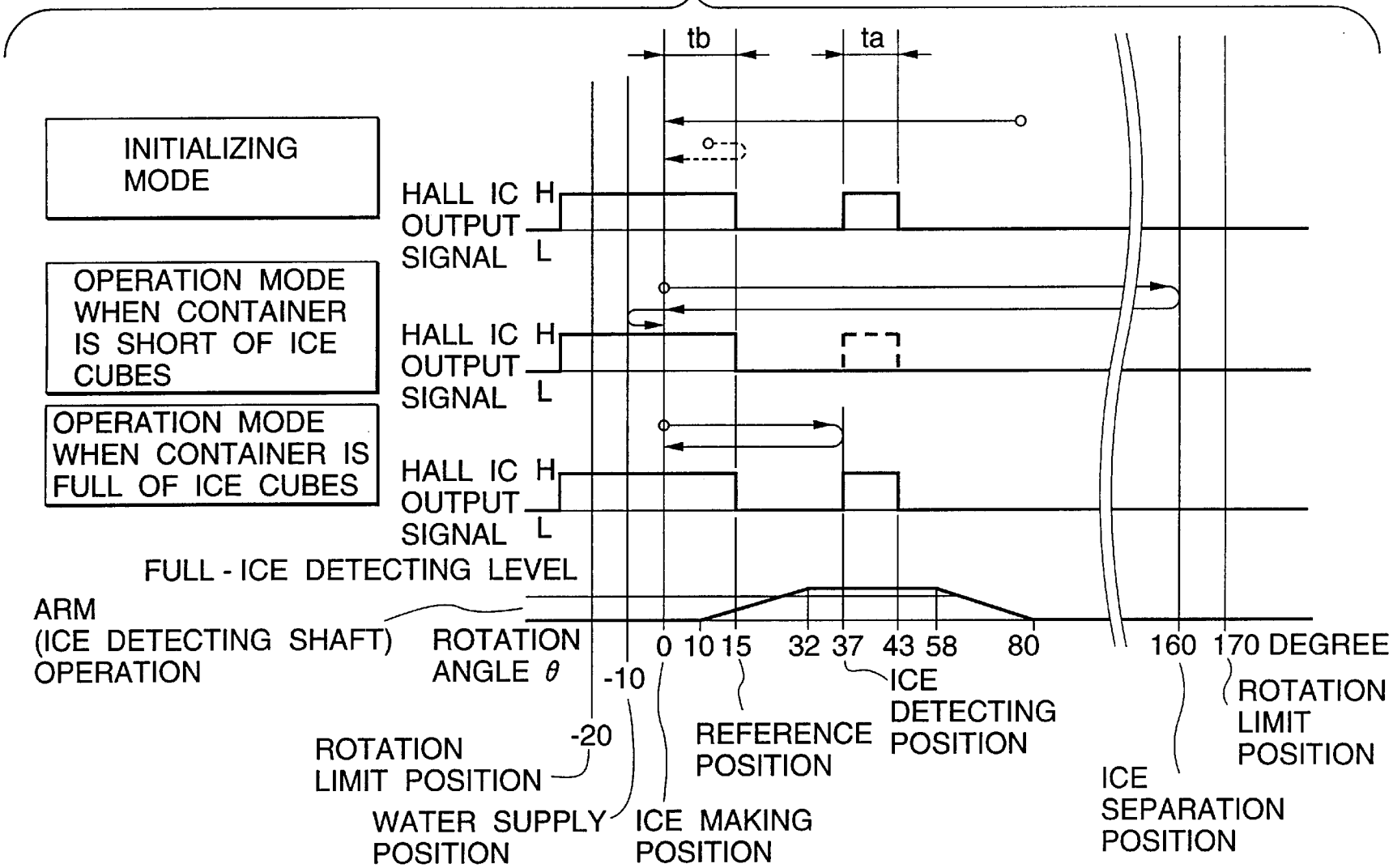
FIG. 13 is a chart showing an operation of the automatic ice making machine of FIG. 1.

It may be designed that the controller 52 starts the execution of the basic operation program in a state that the door of the refrigerator is opened and closed again, and it is confirmed that the ice cubes are formed in the pockets of the ice tray 2. The basic operation program performs the detecting operation of the ice cubes in an operation mode when the container is short of ice cubes and in an operation mode when the container is full of ice cubes (FIG. 13).

When starting the execution of the basic operation program, the controller 52 enters the ice-detecting step S3. In a step S25 in FIG. 16, the controller sets the number of steps of the motor at a value required when the ice storage container is short of ice cubes, and starts the counting the required number of steps; the controller sets the number of steps at a value required for rotating the cam gear 10 from 0° to 160°. Then, the stepping motor 13 is rotated in the forward direction to rotate the cam gear 10 in the CW direction with an arrow head in FIG. 4 (step S26). The controller 52 then advances to a step S27 where it judges as to whether a detecting signal output from the Hall sensor 42 is an L signal or an H signal, and repeatedly executes the step S27 till the L signal is detected. In a state that the H signal (ice-making position signal), not the L signal, is detected, it may be considered that a turn of the cam gear 10 apart from the ice making position is insufficient.

When the cam gear 10 is sufficiently rotated in the CW direction, the first off-signal generating cam part 29*b* of the second cam face 29 for operating the switch mechanism 12 moves the outward-curved portion 41*b* radially outwardly, and the magnet lever 41 is swung. As a result, the detecting (switch) signal of the Hall sensor 42 changes from the H signal to the L signal, and an ice-making position signal is terminated. This position is the reference position in FIG. 13. Therefore, the answer in the step S27 is YES, and the controller 52 advances to a step S28 where it judges as to whether or not the switch continues its generation of the L signal.

If the L signal generation is continued, the controller judges if the set number of steps-is complete (step S29). When about 70% of the set number of steps or an angle of about 110° is reached, the controller enters the ice separation step S4. The controller 52 lowers the drive frequency of the stepping motor 13 (step S30). In this embodiment, it lowers from 600 pps to 300 pps.

Then, the controller checks as to if the number of steps set in the step S25 is reached (step S31), and if it is reached, the controller stops the stepping motor 13 (step S32). The reason why the switch continues the generation of the L signal is that with rotation of the ice-detecting shaft 32, i.e., the ice detecting arm 3, the magnet-swing prohibiting member 43 is sufficiently turned to a position where it comes in contact with the arm 41*c* of the magnet lever 41, to thereby inhibit the turn of the magnet lever 41.

The operation of the automatic ice making machine in the 31 is turned to the insufficient-ice detecting part 28*c* of the first cam face 28, and the magnet-swing prohibiting member 43 provided o the ice-detecting shaft 32 comes in contact with the arm 41*c* of the magnet lever 41 in the switch mechanism 12. Therefore, the magnet lever 41 cannot turn since its motion is restricted by the magnet-swing prohibiting member 43. Because of this, even when the outward-curved portion 41*b* of the switch mechanism 12 reaches the full-ice on-signal generating cam part 29*c* as the recess of the second cam face 29, the outward-curved portion 41*b* does not move along the second cam face 29 and is apart from the second cam face 29. In this state, the magnet 46 is at a position out of the Hall sensor 42 and the Hall sensor 42 continues the supply of an L signal to the controller 52.

Accordingly, the answer of YES continues in the step S28. The controller 52 returns to the step S28 till the predetermined ratio of the number of steps set through the execution of the step S29 is reached. While the ice detecting arm 3 descends, the ice detecting arm 3 cannot turn. Then, the controller 52 does not detect an H signal, and repeats the execution of the steps S28 and S29.

When the cam gear 10 is rotated in the CW direction, the outward-curved portion 41*b* of the magnet lever 41 comes in contact with the second cam face 29 again. Even if the magnet lever 41 is released from its restriction by the magnet-swing prohibiting member 43, it never turns. Thence, when the amount of ice cubes range from the step S28 to the step S29 will be described again in detail. The controller 52 judges if the detecting signal is an L signal in the step S28. An H signal detected in this state is an ice detecting position signal. When it fails to the leading edge of the ice detecting position signal and the answer is YES, the controller 52 advances to the step S29. In this step, the controller checks as to if the counting of a predetermined ratio of the number of steps is complete. The controller 52 repeatedly executes the steps S28 and S29 till the counting of a predetermined number of steps of the set number of steps is complete. In this state, the cam gear 10 is rotating in the CW direction of the arrow in FIG. 4. When the rotation angle θ reaches 10°, the protruded portion 31*a* of the ice-detecting mechanism 11 reaches the ice-detecting descending part 28*b* of the first cam face 28.

When the amount of ice cubes in the tray is insufficient, the ice detecting arm 3 is allowed to lower to a predetermined position without any hindrance by the ice cubes in the ice storage container. Accordingly, the protruded portion 31*a* moves along the ice-detecting descending part 28*b* of the first cam face 28 radially outwardly to turn the ice-detecting-shaft lever 31. As a result, the ice-detecting shaft 32 is rotated and the tip of the ice detecting arm 3 starts to descend.

When the rotation angle θ of the cam gear 10 reaches 32°, the ice detecting arm 3 moves to a position indicated by a two-dot chain line in FIG. 2. At this time, the ice-detecting-shaft lever in the ice tray 2 is insufficient, no ice detecting position signal will be output. In the embodiment, a called active high is used for controlling the operation of the Hall sensor 42.

When the rotation angle θ of the cam gear 10 reaches 58°, the protruded portion 31*a* starts to move radially inwardly along the ice-detecting return part 28*d* of the first cam face 28. When the rotation angle θ reaches 80°, the protruded portion 31*a* of the ice-detecting-shaft lever 31 runs on the ice-detecting non-operation part 28*a* of the first cam face 28, and the ice-detecting-shaft lever 31 returns to the non-operation position. Even in this state, as stated above, the magnet lever 41 does not turn, and the Hall sensor 42 continues the supply of the L signal to the controller 52. Therefore, the controller 52 repeats the execution of the steps S28 and S29.

A short period of time elapses and the rotation angle θ reaches 110°. Then, the drive frequency of the stepping motor 13 decreases, and the motor is rotated by a strong torque. And the number of steps set in the step S25 is reached. As a result, the answer in the step S31 is YES, and the controller 52 advances to the step S32. The controller 52 fails to detect an H signal, or an ice detecting position signal when the motor is rotated by the set number of steps, and then recognizes a shortage of ice blocks in the ice tray.

In the step S32, the controller 52 stops the stepping motor 13 for one second. That is, a position where the rotation angle θ of the cam gear 10 reaches 160° is the ice separation position, and the ice tray 2 hits the contact piece to be twisted, and ice cubes are squeezed out of the pockets of the tray and drop into the ice storage container.

Thereafter, the controller enters the step S5 for ice-piece harvesting. And the controller 52 goes to a step S33 where it sets the number of steps of the motor at a desired one, and reversely turns the cam gear 10 in the CCW direction in FIG. 4 (step S34). Subsequently, the cam gear 10 turns in the reverse direction. After the cam gear 10 reaches 160°, it is further turned in the CW direction; when it reaches 170°, the end face 26*b* of the groove 26 formed in the cam gear 10 is brought into contact with the protrusion of the first case 9*a*, viz., a called mechanical locking state is set up. Therefore, no further turn of the cam gear in the CW direction is permitted.

In the embodiment, the motor is operated at high speed over a range from the ice making position to a position just before the ice separation position (exactly a position where the rotation angle θ of the cam gear 10 is 110°), and then it is operated at low speed (exactly, the half of the high motor speed), viz., its torque is increased, over a range from a position just before the ice separation position to the ice separation position. In other words, the motor speed of the stepping motor 13 is reduced in order to obtain a high torque of the motor during a time period ranging from an instant that the twisting of the ice tray 2 starts till the harvesting of ice cubes starts. This drive method takes only four minutes to rotate the cam gear 10 from the ice making position (0°) to the ice separation position (160°), while the normal drive method takes six minutes to rotate the cam gear such an angular distance. If required, the motor may be operated at constant speed over the whole angular range, as matter of course.

Then, the controller 52 advances to a step S35 where it checks as to if the detecting signal is changed from an L signal to an H signal. If the answer is YES, the controller sets the timer (step S36). In this case, the timer time is set in terms of the number of steps. As shown in FIG. 13, the timer time tb is longer than the full-ice on-signal time ta. The reference position is selected so as to satisfy tb>ta. While the timer is operating, the controller 52 checks as to if the switch continues the generation of the H signal (step S37); if the answer is YES, the controller checks as to if the timer operation terminates (step S38). If it terminates, the controller stops the stepping motor 13 (step S39). This position is the horizontal position of the ice tray 2.

When the cam gear 10 rotates in the CCW direction and the outward-curved portion 41*b* of the switch mechanism 12 passes the full-ice on-signal generating cam part 29*c* of the second cam face 29, the magnet lever 41 may be turned or prohibited from its turn. Therefore, there exist two cases; the signal output of the Hall sensor 42 is an H signal or it is an L signal. The reason for this is that in the return mode of the cam gear, the following two statuses exist. In a first status, the ice storage container is full with ice cubes and the ice detecting arm 3 stops at the full-ice detecting level (indicated by a one-dot chain line in FIG. 2), and cannot further turn. Therefore, the magnet-swing prohibiting member 43 fails to come in contact with the arm 41*c* of the magnet lever 41, and then there is a case that its motion cannot be controlled. In a second status, the ice storage container is not full with ice cubes; the ice detecting arm 3 lowers below the full-ice detecting level; the magnet-swing prohibiting member 43 comes in contact with the arm 41*c* of the magnet lever 41, and its motion is controlled.

The controller checks as if the current number of steps is equal to the set number of steps when the stepping motor 13 is stopped in the step S39 (step S40); if the answer is YES, the controller executes the water-supply step S6. And the controller sets the number of steps of the rotation of the motor in the direction opposite to the ice making position (step S41). Thereafter, the cam gear 10 starts to rotate in the CCW direction (step S42). The controller 52 advances to a step S43 where it checks as to if the current number of steps reaches the set number of steps. If the answer is YES, the controller advances to a step S44, stops the stepping motor for one second, and injects water to the empty ice tray 2.

The water injection, which gradually progresses, starts before the cam gear reaches −15° as the water supply position. This is because the engaging portion 2*b* of the ice tray 2 gradually pushes the first end 4*a* of the swing member 4, and then the valve 8 is gradually opened. Water is supplied in a state that the ice tray 2 is tilted at 15° in the reverse direction, and the stepping motor 13 is completely stopped for one second (step S4). Therefore, the water supply is reliable. To secure an exact amount of supplied water, the motor speed of the stepping motor 13 may be increased over a range from the ice making position (0°) to the water supply position (−15°), or it may be driven at high speed over a range from the start of the opening of the valve 8 till it is completely closed. In this embodiment, the high speed of the motor is 600 pps. Since water is injected in a state that the tray is tilted at −15°, the length m of the edge of the ice tray 2 is selected to be long so as to prevent water from spilling out of the tray if the tray 2 is tilted.

Following the water supply, the controller 52 sets the number of steps at a desired one (step S45), and rotates the stepping motor 13 in the CW direction (step S46). Thereafter, the controller 52 judges as to if the set number of steps is reached (step S47), and if it is reached, the controller stops the stepping motor 13 (step S48). This stop position is the ice making position (0°).

Thereafter, the controller executes the step S7, sets the timer to 60 minutes, and causes it to start its time counting (step S49). The controller checks as to if the set time terminates (step S50), and if it terminates, the controller returns to the step S21. If the program execution start condition is satisfied, the controller starts the execution of the steps S21 to S50 again.

Let us consider a case where the ice storage container contains an insufficient amount of ice cubes. In this case, there is no need of reversing the ice tray 2 and effecting the harvesting of ice cubes, and hence the ice tray 2 is immediately returned to the ice making position.

When the amount of ice cubes in the ice storage container is sufficient, it never happens that the ice detecting arm 3 hits the ice cubes within the container and lowers. Accordingly, the driver unit 5 starts its operation. And when the cam gear 10 is rotated in the CW direction from the ice making position to a position where the rotation angle θ is 37°, the ice-detecting-shaft lever 31 is slightly turned, but the ice detecting arm 3 hits ice cubes and its further turn is prohibited, and the protruded portion 31*a* of the ice-detecting mechanism 11 moves apart from the first cam face 28. Therefore, the magnet-swing prohibiting member 43 cannot restrict the arm 41*c* of the magnet lever 41 of the switch mechanism 12, the outward-curved portion 41*b* of the switch mechanism 12 moves along the full-ice on-signal generating cam part 29*c* as the recess of the second cam face 29, and turns the magnet lever 41.

Figure 16:
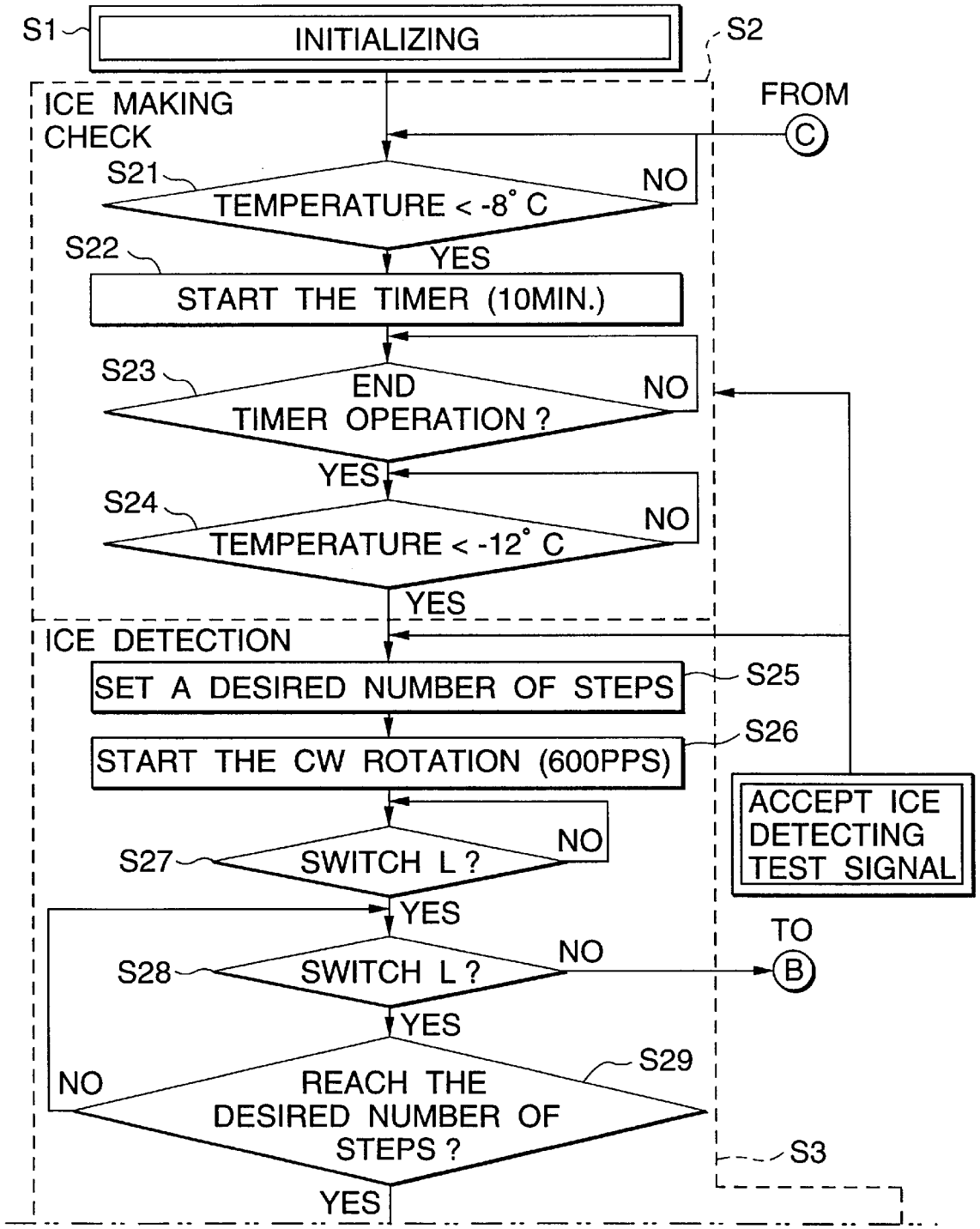
FIG. 16 is a flow chart showing the first half of a basic operation program executed by the controller in the automatic ice making machine of FIG. 1.

Through the turn of the magnet lever 41, a signal output from the Hall sensor 42 changes from an L signal to an H signal in the step S28 in FIG. 16. Specifically, the ice detecting position signal rises; the answer in the step S28 is NO; the controller 52 goes to a step S51 in FIG. 18; and stops the stepping motor 13 for one second. Following this, the operation immediately enters the return mode of the cam gear 10. In this mode, the controller 52 goes to a step S52 where the stepping motor 13 is rotated in the reverse direction in order to rotate the cam gear 10 in the CCW direction.

Thereafter, the controller 52 judges as to if the switch produces an H signal (step S53), and if answer is YES, it sets the number of steps at a desired one to set the time (step S54). In turn, the controller judges as to if the switch outputs an H signal (step S55). If the answer is YES, the controller judges as to if the set number of steps is reached, viz., the timer time terminates (step S56), and if the answer is YES, it stops the stepping motor 13 (step S57). In this case, the timer time is a time lb longer than the full-ice on-signal time ta; tb corresponds to the range from the reference position to the ice making position.

Thus, if the switch produces an H signal when the timer time terminates, the controller judges that the H signal is not the full-ice on-signal but an on signal at the ice making position, and the controller stops the stepping motor 13. As a result, the cam gear 10 is set at a position of 0°. If the switch produces a L signal during the timer time period in the step S55, the position where the H signal is produced is for another signal, and the controller causes the CCW rotation of the stepping motor 13 in order to detect the next H signal.

When the execution of the step S57 ends, the controller 52 executes the step S9 for the stand-by for ice detecting, and sets the timer and causes it to count (st 58). The controller checks as to if a preset time (70 minutes in this embodiment) elapses after the stepping motor 13 is stopped (step S59), and if the answer is YES, the controller returns to the step S21 where it checks as to if temperature is below a predetermined one. Subsequently, the controller repeats a process similar to the above-mentioned one. In the step S59, the elapsing time is measured from an instant that the stepping motor 13 stops. If required, it may be measured from a time point of the preceding temperature detection (step S21).

When the set number of steps is not reached in the step S40, the controller executes an abnormality process of the step S10. In this case, the controller sets the timer and causes it to count time (step S61). Then, the controller checks as to if the timer operation ends (step S62); if the answer is YES, the controller returns to the step S21, not the water supply step S6; and executes the process from the step S21 to the subsequent ones again. In this embodiment, the timer time set in the step S61 is 120 minutes.

Figure 19:
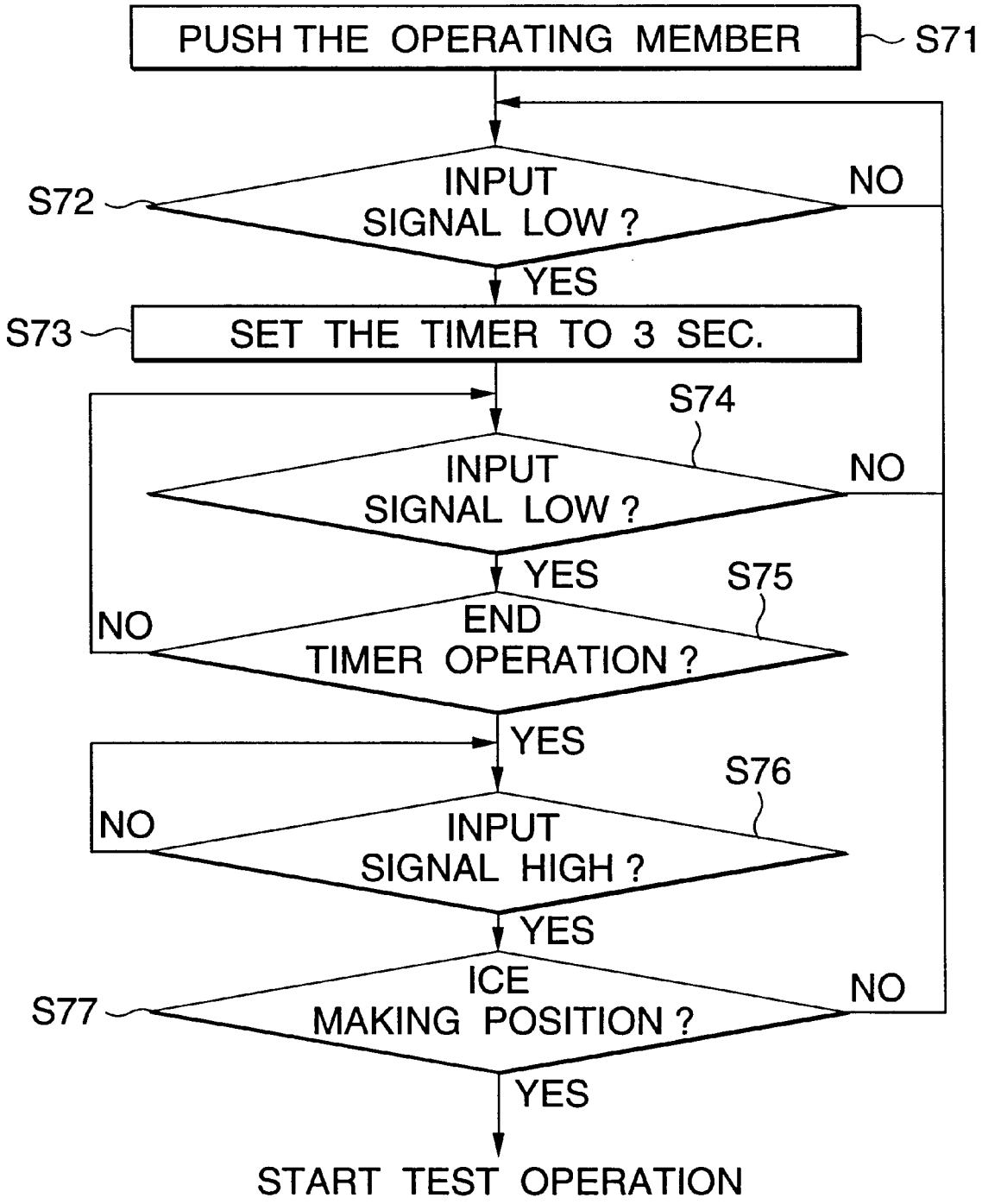
FIG. 19 is a flowchart a process of a test signal acceptance (forcible drive signal acceptance) executed by the controller in the FIG. 1 machine.

A test of the automatic ice making machine is carried out by operating the operating member 47, and its process is as shown in FIG. 19. The operating member 47 is pushed (step S71), and then the controller 52 checks as to if the output signal of the Hall sensor 42 is an H signal (step S72). If the answer is YES, the controller starts the timer (step S73). The controller checks as to if the L signal generation continues within the timer time (step S74). When the sensor output signal returns to the H signal, the controller rejects the test signal and returns to the step S72. In the embodiment, the timer time is 3 seconds.

When the L signal continues, the controller checks as to if the timer operation ends (step S75), and if the answer is YES, the controller judges whether or not the sensor output is an H signal (step S76). If the answer is YES, the controller checks as to if the ice tray 2 is in the step S2, S7 or S9 (step77). If the answer is YES, the controller proceeds to the subsequent operation. Thus, the test signal is accepted when the operating member 47 is pressed for at least three seconds and then it is released. If it is shorter than three seconds, the controller judges that an erroneous operation is performed, and does not start the forcible driving operation.

An ice making position and method of controlling the same, which are constructed according to another aspect of the present invention, will be described with reference to FIGS. 21 through 25.

The ice making position of the second embodiment is also an automatic ice making machine, and its basic construction is substantially the same as of the first embodiment. The difference of this automatic ice making machine from that of the first embodiment resides in that the swing member 4 and the engaging portion 2*b* for mechanically realizing the water supply are not used. In the second embodiment, to water supply, the ice tray 2 is set at the horizontal position, and a water-supply signal drives an electromagnetic valve, which corresponds to the valve 8 in the first embodiment. Since the water supply is carried out at the horizontal position of the tray, a control method of controlling the ice making device is different from that of the first embodiment. Description to follow will be given placing emphasis on this difference of the control method. For simplicity, like or equivalent portions are designated by like reference numerals in the first embodiment.

Figure 22:
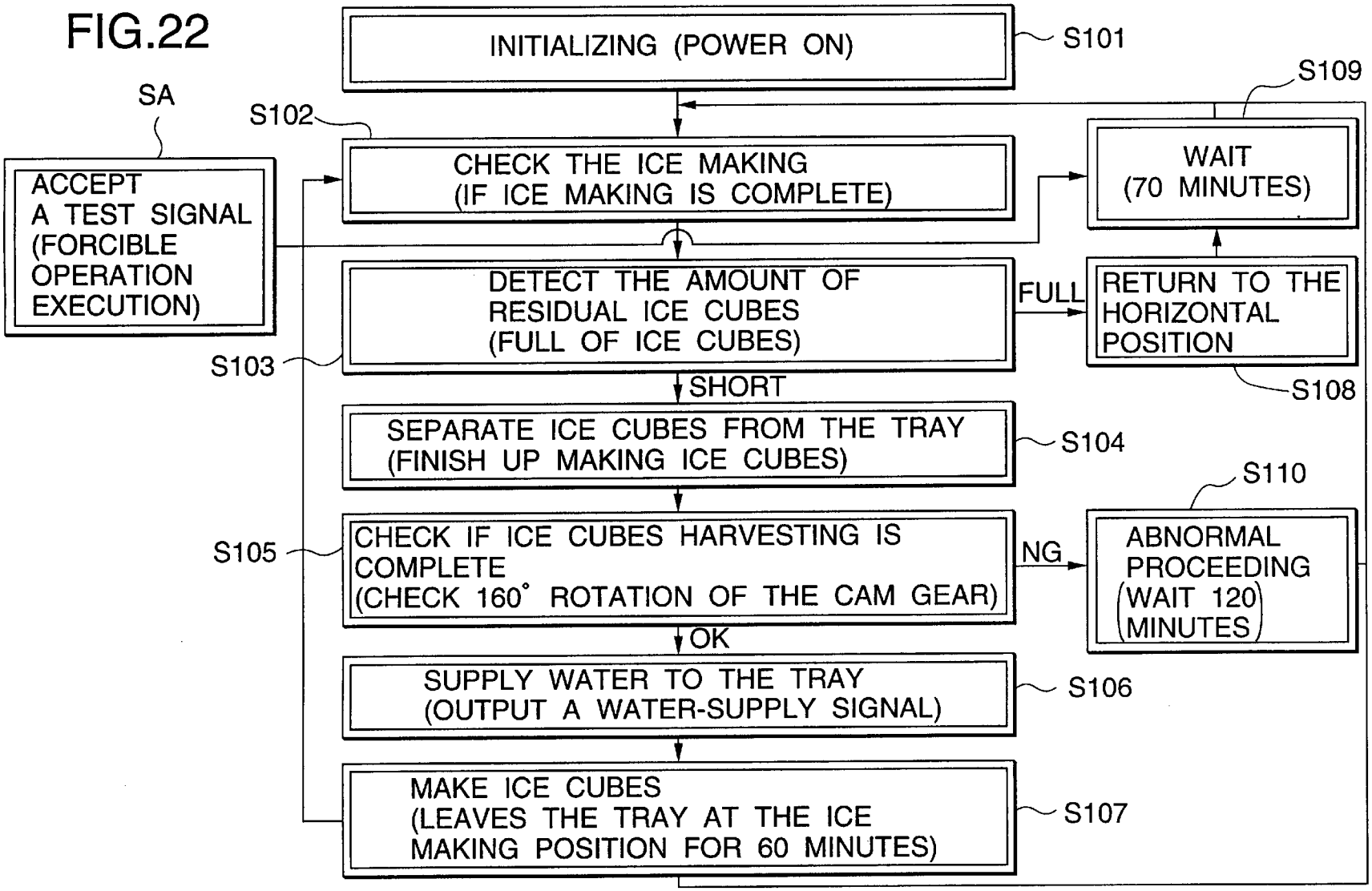
FIG. 22 is a flow chart showing a general control process executed by a controller of the FIG. 20 ice making machine.
Figure 25:
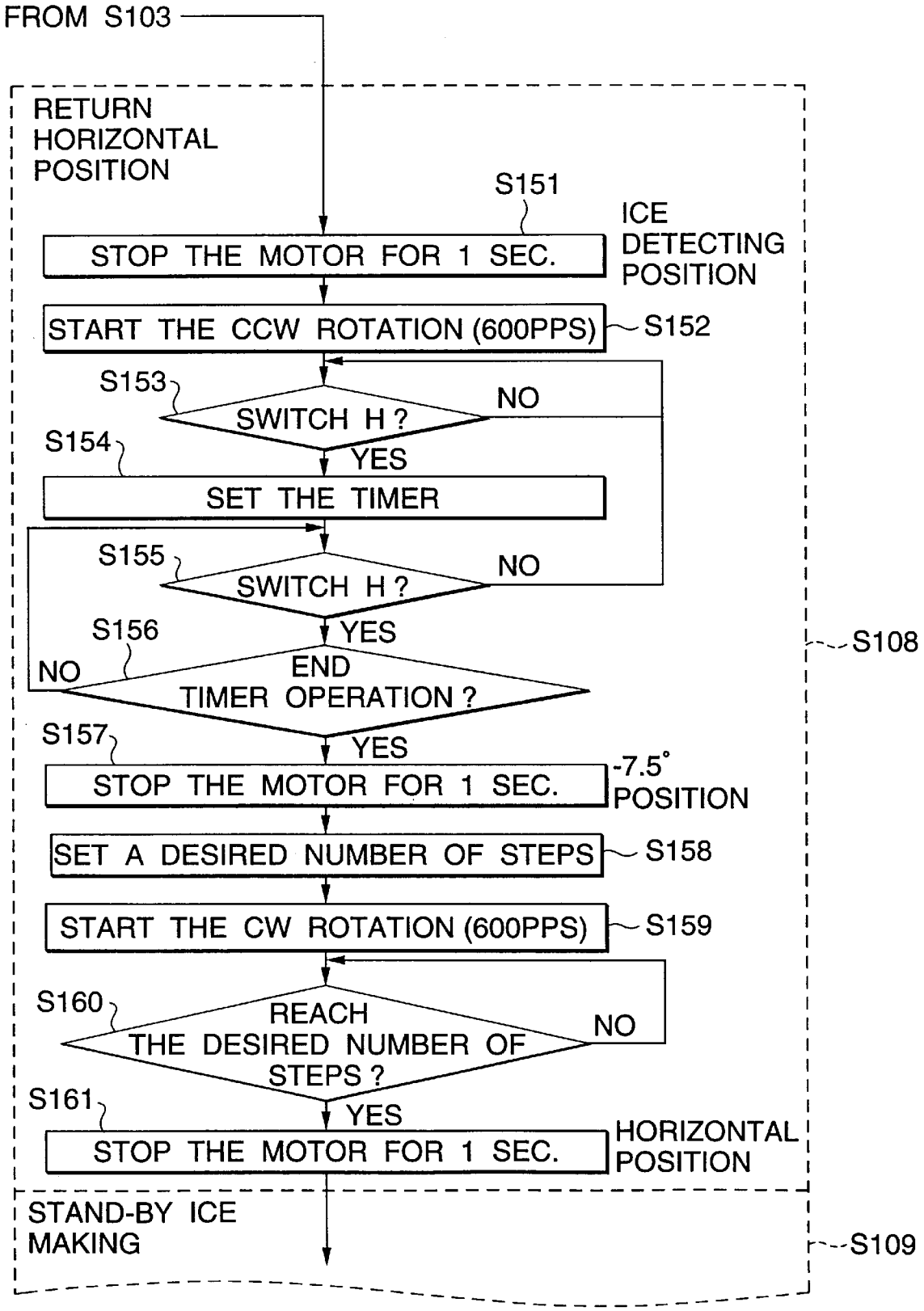
FIG. 25 is a flow chart showing the details of a horizontal-position returning step in the FIG. 20 ice making machine.

An overall operation of the automatic ice making machine (referred to as a second automatic ice making machine) of the second embodiment is as shown in FIG. 22. Upon power on, the initializing program starts to run (step S101). Then, the controller executes the basic operation program and enters an ice making completion check, viz., as to if the ice making is complete (step S102). The controller 52 checks as to if the ice making operation is completed by use of the thermistor 1*a*. In this case, if temperature of the ice tray is lower than a predetermined temperature, the controller judges that the ice making operation is completed, and the controller detects an amount of ice cubes in the ice storage container (step S103).

In the step S103, the controller 52 checks as to whether the ice storage container is full or short of ice cubes. If it is short of ice cubes, it rotates the tray in the opposite direction to eject ice cubes from the tray into the ice storage container (viz., to effect harvesting of ice cubes) (step S104). The controller checks as to if the ice separation is performed, viz., the cam gear 10 is turned through an angle of 160° (step S105). If it is rotated so, the controller returns the ice tray 2 to the horizontal position, and supplies water to the tray (step S106). Then, the ice making operation is performed (step S107).

In the step S3, if the ice storage container is full of the ice cubes, the ice tray 2 is returned to the horizontal position without being reversed (step S108), and waits for a predetermined time for detecting the amount of the residual ice cubes (step S109), and returns to the step S2 (ice-making check). If the ice tray 2 is not turned 160°, the controller executes an abnormality process, viz., waits for a predetermined time (step S110) and returns to the step S2.

When the ice tray 2 stops at the ice making position (=horizontal position), the controller 52 is put in a state that it can accept a change of the signal, caused by the operating member 47. Specifically, the controller 52 accepts a signal only when the operating member 47 is operated in the steps S102, S107 and S109, and executes a forcible-operation execution process (step A) upon receipt of a test signal. As the result of the forcible drive, the ice tray 2 is moved to the ice detecting position, ice separation position, water supply position and ice making position, and the ice detecting arm 3 is operated for ice detecting, for example.

The following steps of the second embodiment are different from those of the first embodiment: step S101 (initializing), step S105 (ice making check), step S106 (water supply), and step S108 (return to the horizontal position). The following steps of the second embodiment resemble the corresponding ones of the first embodiment: step S102 (ice making check), step S103 (ice detection), step S104 (ice separation), step S107 (ice making), step S109 (ice detecting stand-by), and step S110 (abnormality process). Only those different steps will be described hereunder.

The initializing program may be flow charted as shown in FIG. 23. In the initializing program, a state of the magnet lever 41 is first detected. Specifically, the controller 52 judges whether or not the switch outputs an H signal (step S111); if the answer is NO, the stepping motor 13 is rotated in the reverse direction (counterclockwise direction=CC) and the cam gear 10 is rotated toward the ice making position (step S112).

Thereafter, the controller 52 detects whether or not the switch produces an H signal (step S113); if the answer is YES, it sets a timer (step S114). In this case, a timer time is selected to be a time tb, which is longer than a full-ice on-signal time ta, or time taken when the cam gear angularly moves from the reference position to the ice making position; the reference position is selected so as to satisfy a relation tb>ta. The timer time is set in terms of the number of steps by which the stepping motor 13 is rotated.

While the timer operates, the controller 52 checks whether or not the switch continues the outputting of the H signal (step S115); if the answer is YES, it checks as to if the timer operation ends (step S116); and if the answer is YES, it stops the stepping motor 13 (step S117). When the switch still produces the H signal at the end of the timer operation, the controller 52 judges that the H signal is not a full-ice on signal but is an on signal at the ice making position, and stops the stepping motor 13 in its operation.

As a result, the cam gear 10 is set at a position of −7.5°, and the ice tray 2 is slightly tilted. If an L signal is produced within the timer time in the step S115, the position causing the H signal is for a full-ice on signal, and the controller continues of the reverse rotation of the stepping motor 13 in order to detect the next H signal.

When the switch produces an H signal in the step S111, the stepping motor 13 is rotated in the forward direction (clockwise direction=(CW) direction), and it rotates the cam gear 10 toward the ice separation position (step S125). The reason why the motor is rotated in this direction follows. The second automatic ice making machine of the embodiment is designed such that when it is further rotated in the reverse direction beyond the ice making position, it reaches the rotation limit position, and an impact sounds may be generated. To avoid this, the impact sound generation is prohibited during the execution of the initializing program.

After the stepping motor 13 starts the CW rotation (step S125), the controller 52 checks as to if the switch generates an L signal (step S126); if the answer is YES, it stops the stepping motor 13 for one second (step S125). This position is a position of 7.5°. Thereafter, the controller goes to the step S112 and rotates the stepping motor in the CCW direction. Subsequently, the controllers repeats the steps S113 to S117, and rotates the cam gear 10 to the position of 7.5°. Incidentally, After the motor is stopped for one second in the step S117, the controller sets the counter and causes it to start its counting operation (step S118). And the stepping motor 13 rotates in the CW direction (step S119). The controller 52 checks as to if the set count value is reached (step S120). When a desired number of steps is reached, the stepping motor 13 stops (step S121). This stop position is an ice making position, and the ice tray 2 is returned to be horizontal. In the initializing mode, the stepping motor 13 is operated at 600 pps in this embodiment.

Following the initializing mode, the steps S102 (ice making check), step s103 (ice detecting), and step S104 (ice separation) are successively executed. And the controller executes the step S105. The controller 52 advances to a step S133, sets the number of steps to a desired one, and reversely rotates the stepping motor 13 to rotate the cam gear 10 in the CCW direction (FIG. 4) (step S134). Subsequently, the cam gear 10 takes the return course.

Figure 21:
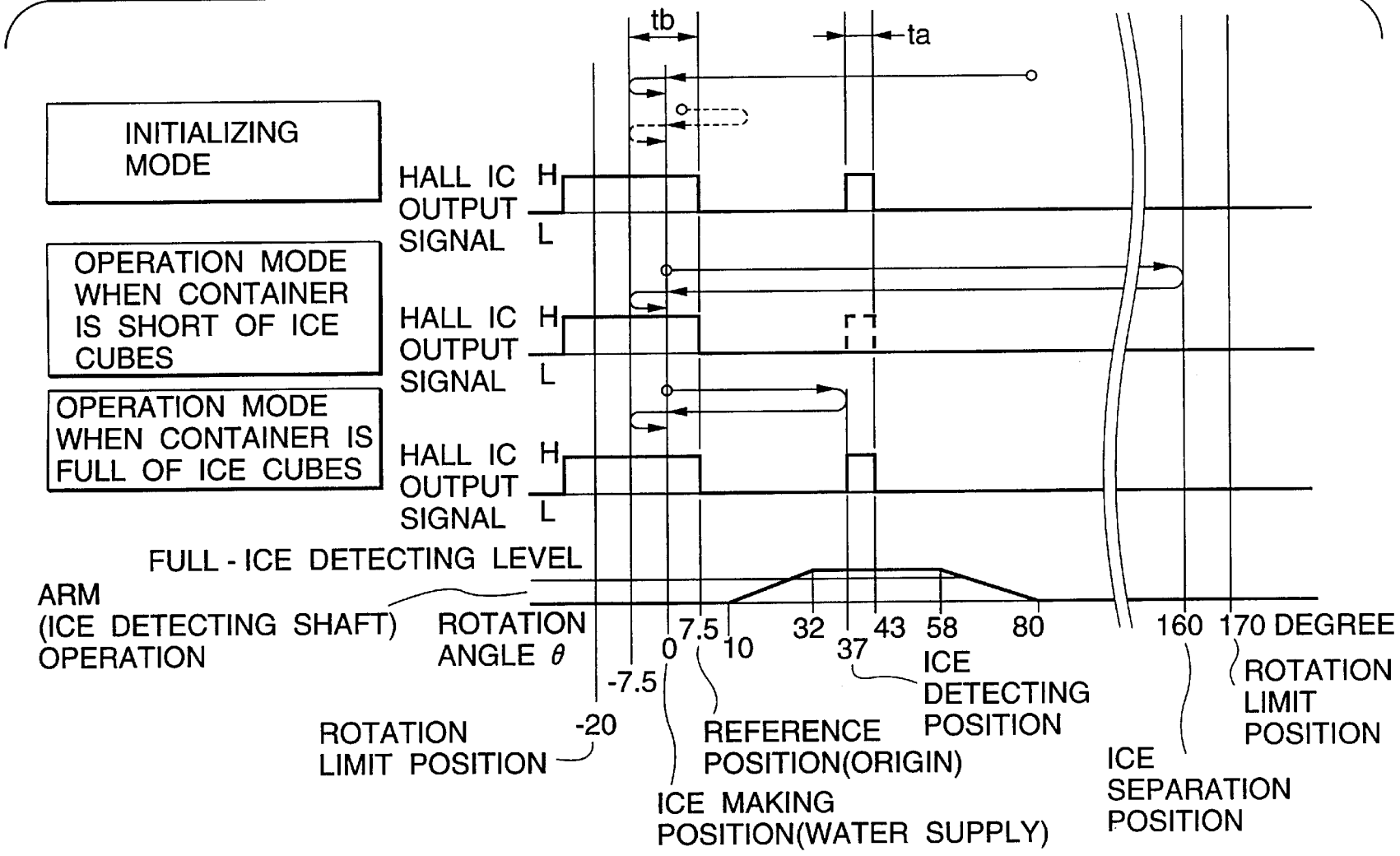
FIG. 21 is a chart showing an operation of an automatic ice making machine according to a second embodiment of the present invention.

Then, the controller 52 advances to a step S135, and checks as to if the detecting signal changes from an L signal to an H signal. If the answer is YES, the controller sets the timer (step S136). In this case, a timer time is set in terms of the number of steps, and as shown in FIG. 21, it is selected to be a time tb, which is longer than a full-ice on-signal time ta; the reference position is selected so as to satisfy a relation tb>ta. While the timer operates, the controller 52 checks whether or not the switch continues the outputting of the H signal (step S137); if the answer is YES, it checks as to if the timer operation ends (step S1138; and if the answer is YES, the controller stops the stepping motor 13 (step S139). This position is a position of −7.5° of the turn of the ice tray 2.

After the ice tray 2 stops at the position of −7.5°, the number of steps set in the step S133 is reversely counted (step S140), and the controller sets the number of steps to the number of steps required for the tray to reach the horizontal position. Thereafter, the stepping motor 13 starts its CW rotation (step S142). The controller 52 checks as to if the count set in the step S141 is complete (step S143), and if the answer is YES, it stops the stepping motor 13 (step S144). This position is the horizontal position of the ice tray 2.

When the stepping motor 13 stops in the S144, the controller checks as to if the number of steps is equal to that set in the step S133 (step S145), and if it is reached, the controller executes the water supply step S106. Then, the controller 52 produces a water supply signal (step S146), and opens the electromagnetic valve for controlling the supply of water to the ice tray 2, and allows water to be supplied to the ice tray 2. The water supply signal has a time duration of five seconds in this embodiment. Thus, the water supply is performed at the horizontal position. Therefore, the edge length m of the ice tray 2 is shorter than that of the first embodiment.

After the water supply is performed, the controller executes the step S107, and sets the timer to a predetermined time, 60 minutes in the second embodiment, as in the first embodiment, and causes it to count.

When the ice storage container is short of ice cubes, the 3 hits the ice cubes and cannot descend. Therefore, the driver unit 5 starts its operation; the cam gear 10 is rotated from the ice making position in the CW direction, and when it is rotated to a position of 37°; the ice-detecting-shaft lever 31 is slightly turned but the ice detecting arm 3 cannot be turned further since it is blocked by ice cubes; and the protruded portion 31*a* of the ice-detecting mechanism 11 moves apart from the first cam face 28. Therefore, the magnet-swing prohibiting member 43 cannot restrict the arm 41*c* of the magnet lever 41 in the switch mechanism 12; the outward-curved portion 41*b* in the switch mechanism 12 moves along the full-ice on-signal generating cam part 29*c* as the recess of the second cam face 29; and the magnet lever 41 is turned.

Through the turn of the magnet lever 41, a signal output from the Hall sensor 42 changes from an L signal to an H signal (see the step S28 in FIG. 16). Specifically, the ice detecting position signal rises; the answer in a step corresponding to the step S28 is NO; the controller 52 goes to a step S151 in FIG. 25; and stops the stepping motor 13 for one second. Following this, the operation immediately enters the return mode of the cam gear 10. In this mode, the controller 52 goes to a step S152 where the stepping motor 13 is rotated in the reverse direction in order to rotate the cam gear 10 in the CCW direction.

Thereafter, the controller 52 judges as to if the switch produces an H signal (step S153), and if answer is YES, it sets the number of steps at a desired one to set the time (step S154). In turn, the controller judges as to if the switch outputs an H signal (step S155). If the answer is YES, the controller judges as to if the set number of steps is reached, viz., the timer time terminates (step S156), and if the answer is YES, it stops the stepping motor 13 (step S157). In this case, the timer time is a time tb longer than the full-ice on-signal time ta; tb corresponds to the range from the reference position to the ice making position.

Thus, if the switch produces an H signal when the timer time terminates, the controller judges that the H signal is not the full-ice on-signal but an on signal at the ice making position, and the controller stops the stepping motor 13. As a result, the cam gear 10 is set at a position of −7.5°. If the switch produces a L signal during the timer time period in the step S155, the position where the H signal is produced is for another signal, and the controller causes the CCW rotation of the stepping motor 13 in order to detect the next H signal.

After the stepping motor 13 stops for one second, the controller 52 sets the number of steps to a predetermined one, and causes it to count (step S158). And the stepping motor 13 starts its CW rotation (step S159). The controller 52 checks as to if the predetermined number of steps is reached (step S160), and if the answer is YES, the controller stops the stepping motor 13 (step S161). This position is the horizontal position.

After completing the execution of the step S161, the controller goes to the step S109 for ice detecting stand-by, and subsequently performs a similar process to that in the first embodiment.

In the first and second embodiments, the stepping motor 13 is used for a drive source. Generally, a torque of the stepping motor is smaller than of the DC motor. To compensate for this, in the invention, a reduction ratio of the gear train for transmitting a rotation force from the motor shaft to the ice tray 2 is set at a large value so as to produce a torque comparable with that by the DC motor. Further, in an ice separation mode requiring large torque, the number of revolutions of the motor is reduced, while in other modes, it is increased. Thus, the motor speed is selectively controlled by the controller.

In the above-mentioned embodiments, to inhibit a signal from being generated at the ice separation position, check as to if the ice separation position is reached is made depending on the number of steps of the motor 13 during a time period taken for the cam gear to turn from the ice separation position (160°) to the ice making position (0°). When the ice separation position is not reached, the water supply is stopped, and after some time elapses, the harvesting operation is performed. Therefore, a mistaken water supply is reliably prevented.

In the second embodiment, the stepping motor 13 is used, but mechanical means is not used for the water supply. Therefore, the water supply position is the ice making position. Because the mechanical means is not used for the water supply, the ice tray may be turned beyond the ice making position in the initializing mode. Therefore, the origin detection signal may be within a range between −7.5° to 7.5°. In the initializing starting from the ice making position, the tray is first turned through an angle of 7.5° toward the ice making position and then an angle of 15° toward the ice separation position, and when it reaches a position of −7.5°, it is confirmed that it is a signal for origin detection. Following this, the tray is turned to the ice making position of 0°. Where the mechanical means is not used for the water supply, a tilt of the ice tray 2 from the horizontal position may thus be small.

While some specific embodiments of the present invention have been described, it should be understood that the invention may variously be modified, altered and changed within the true spirits of the invention. An example of such is shown in FIG. 26. In the example, the relation tb>ta is used as it is. A signal which is switched in state at the reference position is a signal continuing from the reference position to the ice making position, and it is returned to its original state at the ice making position. In this case, the initializing operation is preferably designed such that if the cam gear 10 is at any angular position, it is turned to the ice separation position at the start of driving. Only when the initializing mode is exercised in a state that it is between the ice detecting position and the ice separation position, the rotation direction of the tray is changed by the utilization of the rotation limit position of 170°. If necessary, various set values may be changed; for example, the water supply position is set at −100° and the ice detecting position is set a 41°.

In the embodiments mentioned above, the controller accepts a forcible drive signal only when the ice tray 2 stops at the ice making position. In an alternative, it may accept the forcible drive signal when it is generated in positions including the ice making position where a signal should not be generated. The output signal of the Hall sensor 42 may be varied in another manner: for example, a magnet additionally used is made to approach the sensor or a shutter for shutting magnetic flux is inserted between the Hall sensor 42 and the magnet 46.

Figure 27:
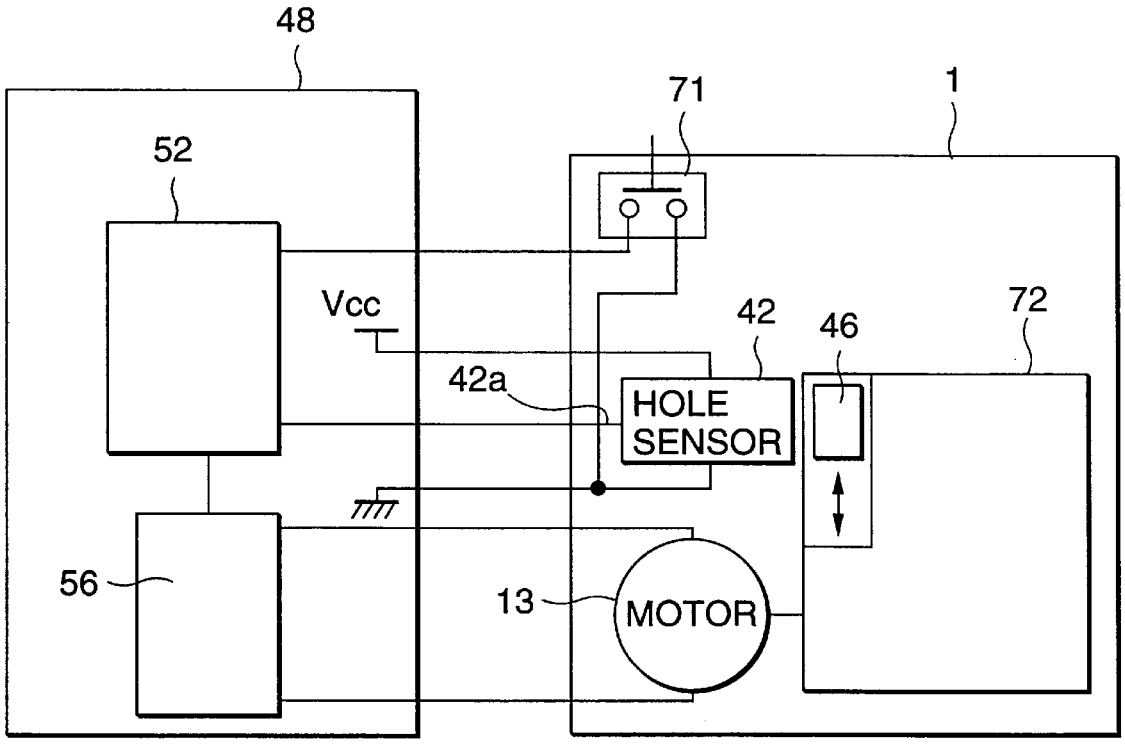
FIG. 27 is a block diagram showing an electrical connection of an automatic ice making machine according to the present invention, the machine being provided with a test switch.

As in an electrical connection shown in FIG. 27, a test switch 71 may be attached to the automatic ice making machine 1 or the second automatic ice making machine, while omitting the operating member 47. The test switch 71 is connected at one end to ground of the Hall sensor 42, while at the other end to the controller 52 contained in the control board 48 of the refrigerator body. An output terminal 42*a* of the Hall sensor 42 is connected to the controller 52 for inputting an output signal of the sensor to the controller.

The controller 52 operates the drive circuit 56 on the control board 48 to control the stepping motor 13. The stepping motor 13 operates an operation mechanism 72 including the cam gear 10 and others.

Where the electrical connection is used, the test switch 71 is turned on and its signal generated is sent to the controller 52 in order to an operation check after the initializing mode or to make the ice storage container empty when the refrigerator is moved to another place. In response to this signal, the controller 52 forcibly drives the stepping motor 13, turns the ice tray 2 from the ice making position to the ice separation position, and then returns it to its original position.

The output shaft 25 may be separate from the cam gear 10 as a cam while those are integral with each other in the above-mentioned embodiments. The protruded portion 31*a* of the ice-detecting-shaft lever 31, which serves as a cam follower may angularly be urged radially inwardly, not outwardly, with respect to the center of rotation of the cam gear 10.

The protruded portion 31*a* serving as a cam follower may be formed on the ice-detecting shaft 32 per se, while it is formed on the ice-detecting-shaft lever 31 fastened to the ice-detecting shaft 32 in the above-mentioned embodiments. In place of the engaging portion 2*b* of the ice tray 2, an engaging portion, which engages with the swing member 4, may be formed on the output shaft 25, or an arm is attached to the output shaft 25 and the swing member 4 is operated by the arm.

In the embodiments, the H signal is generated only when the ice storage container is full of ice cubes. Instead of this, it may be generated when the container is shot of ice cubes. For the control of the Hall sensor 42 relative to the magnet lever 41, the active high is used where the H signal is generated when the magnet lever 41 confronts the Hall sensor 42. The active low may be used instead for the same purpose. Signal generating means may be another optical means utilizing the combination of a light emitting element, a photo sensing element and shielding means.

For the position control, the combination of a normal small-sized motor, e.g., a DC motor, and an encoder for detecting an amount of rotation of the motor may be used in place of the stepping motor 13. Alternatively, an angle detector, e.g., a potentiometer, for directly detecting an angle of the ice tray 2 may be combined with a small-sized motor, e.g., a DC motor. In another alternative, an AC motor or a condenser motor is used. In this case, a rotation angle of the cam gear 10 is detected in terms of time, not the number of steps.

In a modification of the embodiment, when the tray is turned from the horizontal position to the water supply position, the timer or a predetermined number of steps is detected while checking as to if the H signal is continued. If so done, detection of the water supply position is more reliable. The water to be formed into ice may be soft drink, e.g., juice or non-drinking water, e.g., reagent. Means to check the formation of ice cubes in the container may be bimetal device utilizing a shape memory alloy, instead of the thermistor 1*a*.

The valve 8 as liquid supplying means may be integral with the swing member 4 as liquid-supply operation means. A switch mechanism may be used in place of the swing member 4. In this case, by pushing the switch , the valve 8 is operated. Further, a string like a cord suspending from a fan may be used. In this case, the tray is turned from the ice making position to the water supply position by pulling the string.

As seen from the foregoing description, in an ice making device constructed according to the present invention, only a predetermined position is detected by detecting means, and the positioning of other positions may be controlled by use of the number of steps of a stepping motor. Therefore, in an initializing mode, the ice tray may reversely be turned beyond an ice making position. Further, in this mode, no mechanical locking phenomenon occurs, and vibration sound and impact sound are not generated.

In a method for controlling the ice making device, a reference position of the ice tray is detected by detecting means, and a turn of the ice tray from it to another position is measured in terms of the number of steps of the stepping motor. Therefore, the ice tray may be driven in various manners, and no mechanical locking phenomenon occurs in the initializing mode.

What is claimed is:

1. An ice making device comprising:

an ice tray for making ice cubes;

ice separating means for separating ice cubes from said ice tray by turning said ice tray;

an ice storage container for storing separated ice cubes;

a drive source for said ice separating means being a stepping motor;

detecting means for detecting a predetermined position of said ice tray; and control means for controlling a drive of said stepping motor, wherein said control means determines a predetermined position of said ice tray by use of a signal from said detecting means, and determines other positions of said ice tray by the utilization of the number of steps of said motor counted from said predetermined position.

2. An ice making device according to claim 1, wherein said predetermined position is a reference position used for checking a position of said ice tray in intializing mode, and said other positions are at least three positions, an ice making position for transforming liquid in said ice tray into ice cubes, a water supply position for supplying liquid to said ice tray, and an ice separation position for transferring ice cubes made from said ice tray to said ice storage container.

3. An ice making device according to claim 2, wherein said control means includes:

measuring means for measuring the number of steps of said stepping motor when said ice tray is turned from said ice making position to said water supply position or said ice tray is returned to said ice making position; and comparing means for comparing the measuring result with a predetermined number of steps of said stepping motor used when said ice tray is returned from said ice separation position to said water supply position or said ice making position, wherein said control means confirms that said ice tray has reached said ice separation position.

4. An ice making device according to claim 1, further comprising:

a reduction gear train, provided between said stepping motor and said ice tray, for transmitting a rotation force from said stepping motor to said ice tray while reducing a motor speed of said stepping motor, wherein the motor speed of said stepping motor is reduced immediately before said ice separation position where ice cubes are is transferred from said ice tray to said ice storage container.

5. An ice making device according to claim 1, further comprising:

an operating member for externally operating a test signal for forcibly driving said ice tray.

6. An ice making device according to claim 5, wherein when said ice tray is forcibly driven, said ice tray is angularly moved to said ice separation position, said water supply position and said ice making position.

7. A method of controlling an ice making device in which said ice making device includes an ice tray for making ice cubes at an ice making position, ice separating means for separating ice cubes from said ice tray at an ice separation position by turning said ice tray, liquid supplying means for supplying liquid to said ice tray at a water supply position, and an ice storage container for storing separated ice cubes, comprising the steps of:

driving said ice tray by a stepping motor;

detecting a predetermined position of said ice tray as a reference position;

detecting a position of said ice tray by the utilization of said reference position;

measuring a shift of said ice tray to any of other position in terms of the number of steps of said stepping motor; and stopping said stepping motor when a predetermined number of steps is reached.

8. The control method according to claim 7, wherein a reduction gear train for transmitting a rotation force from said stepping motor to said ice tray while reducing a motor speed of said stepping motor is provided between said stepping motor and said ice tray, wherein the motor speed of said stepping motor is reduced immediately before said ice separation position where ice cubes are is transferred from said ice tray to said ice storage container.

9. The control method according to claim 7, wherein said stepping motor is driven at high speed over a range from said ice making position to said water supply position.

10. The control method according to claim 7, wherein detecting means for generating a signal during a predetermined spatial range continuing from said predetermined position, and said ice making position is contained in said predetermined spatial range.

11. The control method according to claim 7, wherein said water supply position is contained in said predetermined spatial range.

12. The control method according to claim 10, wherein said water supply position and ice making position are the same position.

* * * * *